US008981747B2

(12) United States Patent
Saito et al.

(10) Patent No.: US 8,981,747 B2
(45) Date of Patent: Mar. 17, 2015

(54) REGULATOR

(75) Inventors: Hiroshi Saito, Tokyo (JP); Yuichi Goto, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 285 days.

(21) Appl. No.: 13/571,326

(22) Filed: Aug. 9, 2012

(65) Prior Publication Data

US 2013/0249294 A1 Sep. 26, 2013

(30) Foreign Application Priority Data

Mar. 21, 2012 (JP) ..... P2012-064227

(51) Int. Cl.
*G05F 1/575* (2006.01)

(52) U.S. Cl.
CPC ..... *G05F 1/575* (2013.01)
USPC ..... 323/280

(58) Field of Classification Search
CPC ..... G05F 1/575
USPC ..... 323/280
See application file for complete search history.

(56) References Cited

U.S. PATENT DOCUMENTS

| | | | | |
|---|---|---|---|---|
| 6,690,147 | B2 | 2/2004 | Bonto | |
| 7,598,716 | B2 * | 10/2009 | Schlueter et al. | 323/280 |
| 2007/0024350 | A1 | 2/2007 | Huang | |
| 2007/0159146 | A1 * | 7/2007 | Mandal | 323/280 |
| 2009/0179622 | A1 | 7/2009 | Ivanov et al. | |
| 2010/0045252 | A1 | 2/2010 | Yamamoto | |
| 2010/0117609 | A1 | 5/2010 | Koleno | |
| 2010/0289475 | A1 * | 11/2010 | Lipka | 323/315 |
| 2011/0121800 | A1 | 5/2011 | Drebinger | |
| 2011/0128277 | A1 | 6/2011 | Murakami | |

FOREIGN PATENT DOCUMENTS

| | | | |
|---|---|---|---|
| CN | 1713521 | A | 12/2005 |
| CN | 1777026 | A | 5/2006 |
| CN | 101271344 | A | 9/2008 |
| JP | 08056128 | A | 2/1996 |
| JP | H08-148954 | A | 6/1996 |

(Continued)

OTHER PUBLICATIONS

Chinese Office Action, Patent Application No. 201210520813.4, dated Jul. 2, 2014.
Japanese Office Action, Patent Application No. 2012-064227, dated Jun. 17, 2014.

*Primary Examiner* — Harry Behm
(74) *Attorney, Agent, or Firm* — Patterson & Sheridan, LLP

(57) ABSTRACT

The regulator has a differential circuit that generates a comparison signal corresponding to the difference between an input voltage and a voltage related to the output voltage, a first transistor that adjusts the output voltage in accordance with the comparison signal, a first current mirror circuit connected to a pair of differential output lines of the differential circuit, a second transistor that amplifies the high frequency signal superposed on the output voltage and sends the amplified signal to one of the differential output lines, a second current source that feeds current for amplifying the high frequency signal to the second transistor, a first capacitor, which accumulates charge therein as a result of the high frequency signal and controls the current flowing to one the pair of differential output lines via the second transistor in accordance with the charge quantity, and a second capacitor connected to the output voltage line.

23 Claims, 18 Drawing Sheets

(56) References Cited

FOREIGN PATENT DOCUMENTS

| | | | |
|---|---|---|---|
| JP | 2007-194312 | A | 8/2007 |
| JP | 2007-249712 | A | 9/2007 |
| JP | 2010-004258 | A | 1/2010 |
| JP | 2011090683 | A | 5/2011 |
| JP | 2011113567 | A | 6/2011 |
| JP | 2011172203 | A | 9/2011 |
| JP | 2012016123 | A | 1/2012 |

* cited by examiner

REGULATOR

CROSS-REFERENCE TO RELATED APPLICATION

This application is based upon and claims the benefit of priority from Japanese Patent Application No. 2012-064227, filed Mar. 21, 2012; the entire contents of which are incorporated herein by reference.

FIELD

Embodiments described herein relate generally to a regulator that carries out regulation of a DC voltage without performing a switching operation.

BACKGROUND

When a voltage difference between an input voltage VIN and an output voltage Vout is large, a switching regulator, which uses an inductor and a switching transistor to transform magnetic energy stored in the inductor to a DC voltage, is usually employed. However, the switching regulator has a complicated circuit design and a significant noise level.

When the voltage difference between the input voltage VIN and the output voltage Vout is small, a series regulator having a simple circuit design and low noise level is usually employed. The series regulator does not use magnetic energy, and instead directly transforms the input voltage VIN to the output voltage Vout, resulting in a significant thermal loss. In addition, there is a proportional relationship between conductive loss and the voltage difference between the input voltage VIN and the output voltage Vout. To reduce conductive loss, a low dropout (LDO) regulator, which is a type of series regulator that can work when the potential difference is as small as about 0.1 V, is often used.

In recent years, with progress made in forming finer semiconductor integrated circuit devices and lowering the operating voltages thereof, a tolerable power supply voltage range of CPU and other semiconductor devices has become narrower. However, during operation, the load current drawn by such devices may vary significantly corresponding to their operation mode, and so they usually require the variation in the output voltage to be 50 mV or lower even when there is a drastic change in the load current.

In order to meet demand, a broader band low dropout regulator is needed. However, for the conventional low dropout regulator, as the band is made wider, the power consumption rises.

DETAILED DESCRIPTION

According to embodiments disclosed herein, a regulator that can realize a broader band without an increase in power consumption is provided.

According to one embodiment, there is provided a regulator that has the following parts: a differential circuit that generates a comparison signal corresponding to the voltage difference between the reference voltage and a voltage related to the output voltage, a first current source that supplies current to the differential circuit, a first transistor that adjusts the output voltage based on the input voltage corresponding to the comparison signal, a first current mirror circuit connected with a pair of differential output lines of the differential circuit, a second transistor that amplifies the high frequency signal superposed on the output voltage and feeds it to one line of the pair of differential output lines, a second current source that supplies the current for amplifying the high frequency signal in the second transistor, and a first capacitor, which accumulates charge therein as a result of the high frequency signal and which controls the current flowing to the one line of the pair of differential output lines via the second transistor in accordance with the charge quantity.

(Embodiment 1)

Figure 1:
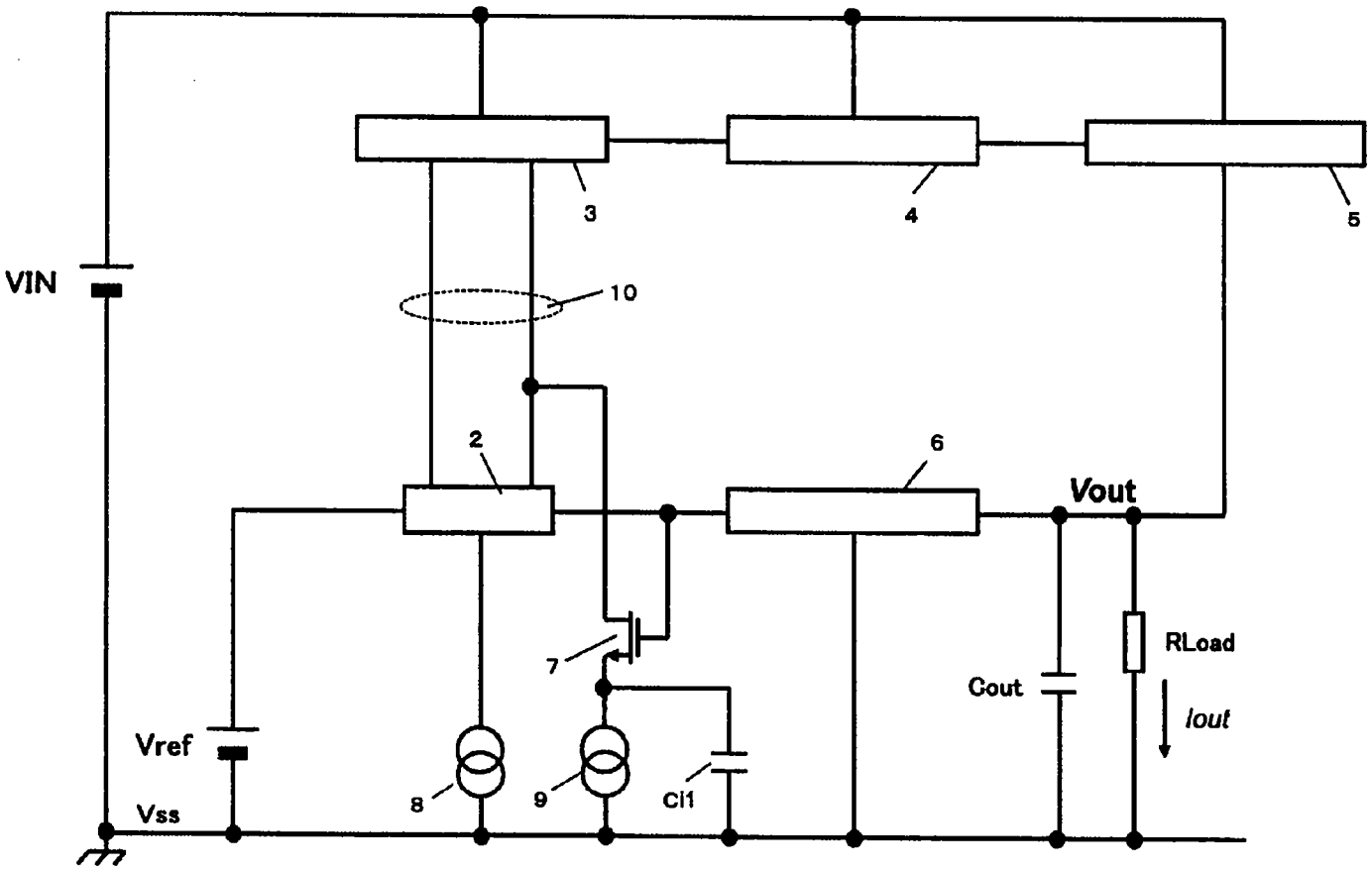
FIG. 1 is a circuit diagram illustrating the internal constitution of an LDO regulator according to a first embodiment.

FIG. 1 is a circuit diagram illustrating the internal structure of the low dropout regulator (hereinafter to be referred to as LDO regulator) according to Embodiment 1. An LDO regulator 1 shown in FIG. 1 has the following parts: a differential circuit 2, a first current mirror circuit 3, a phase compensating circuit 4, an output-stage transistor 5 (first transistor), a voltage dividing circuit 6, a broadband control transistor 7 (second transistor), a phase compensating capacitor Ci1 (first capacitor), a first current source 8, a second current source 9, and an output capacitor Cout (second capacitor).

Figure 2:
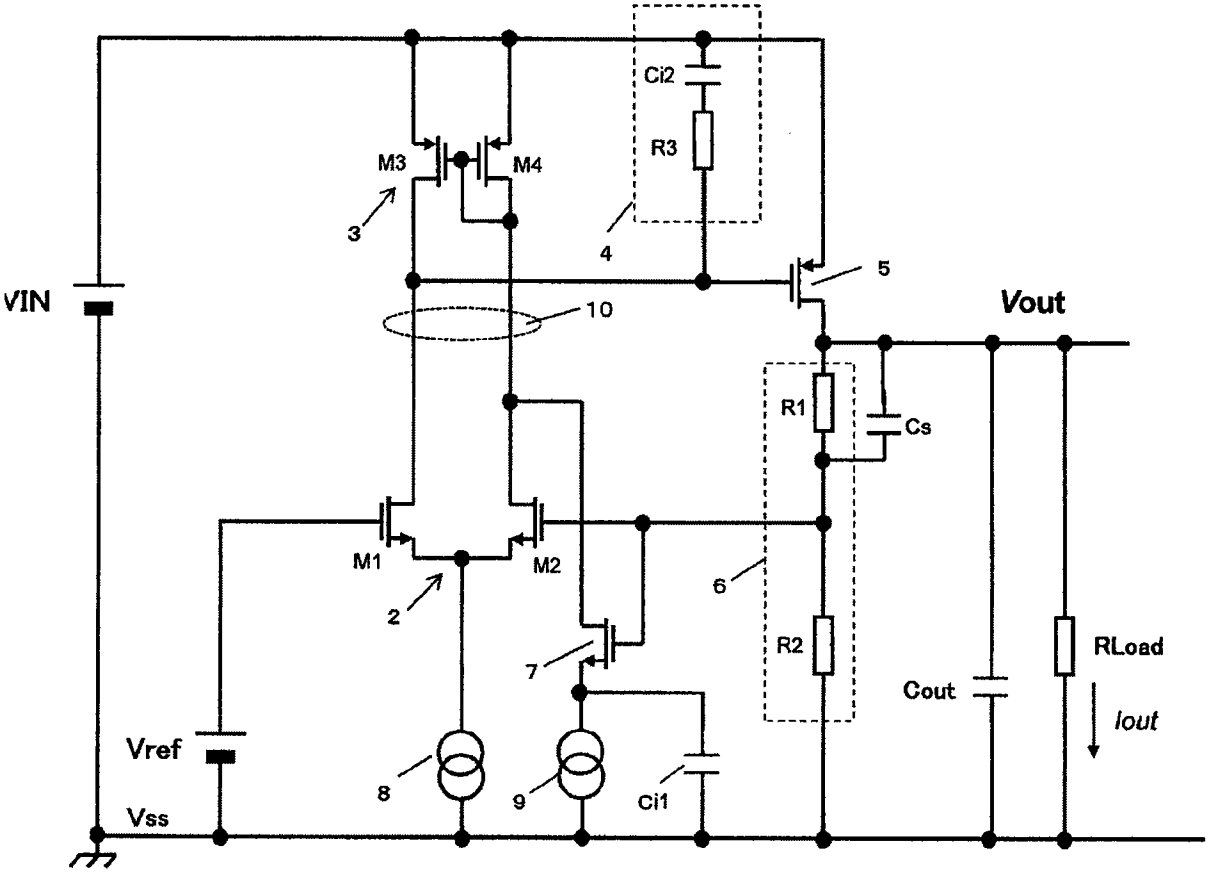
FIG. 2 is a circuit diagram illustrating a specific example of the internal constitution of various elements shown in FIG. 1.

FIG. 2 is a circuit diagram illustrating a specific example of the internal constitution of the differential circuit 2, the first current mirror circuit 3, the phase compensating circuit 4, the output-stage transistor 5 and the voltage dividing circuit 6 shown in FIG. 1. What is shown in FIG. 2 is merely an example, and the internal constitution of these circuit components is not limited to that shown in FIG. 2.

As shown in FIG. 2, the voltage dividing circuit 6 has multiple resistors R1, R2 connected in series between the output voltage line Vout, which outputs the output voltage Vout, and a ground line Vss. A divided voltage Vdiv obtained by dividing output voltage Vout is output from between the resistors R1, R2. The two ends of the resistor R1 are connected in parallel with a speedup capacitor Cs.

The output capacitor Cout is connected between the output voltage line Vout and the ground line Vss. For the LDO regulator 1 in the related art, in order to make phase compensation, as a specific type of the output capacitor Cout, the capacitor (such as a tantalum capacitor or an electrolytic capacitor) with a high loss resistance component of the dielectric and electrode is used, or ESR (Equivalent Series Resistor) as a part separate from the capacitor is connected in series with the capacitor in many cases. However, according to the present embodiment, as to be explained later, there is no need to carry out phase compensation by the output capacitor Cout, so that a ceramic capacitor may be used. It is well known that a ceramic capacitor has a small resistance value for the ESR arranged inside it. According to the present embodiment, there is no need to attach an external ESR to the ceramic capacitor.

It is well known that the tantalum capacitor and electrolytic capacitor are dangerous because they are fire hazards. Because a ceramic capacitor, which is not a fire hazard, can be used here, it is possible to improve the reliability of the LDO regulator.

A load resistor Rload is connected in parallel with the output capacitor Cout. It is assumed that the resistance value of the load resistor Rload varies according to the operation of the load. For example, when a CPU is connected as a load, depending on the operation mode of the CPU, there may be a significant variation in the load current, so that the load resistor Rload also changes correspondingly. According to the present embodiment, even when the load resistor Rload varies, variation in the output voltage Vout over a broadband can still be suppressed.

The differential circuit 2 generates a comparison signal corresponding to the voltage difference between a reference voltage Vref and the divided voltage Vdiv. Here, the differential circuit 2 has a pair of NMOS transistors M1, M2 with their sources having a common connection. The reference voltage Vref is input to the gate of the NMOS transistor M1, and the divided voltage Vdiv is input to the gate of the NMOS transistor M2. The first current mirror circuit 3 is connected to the drains of the NMOS transistors M1, M2. As used herein, the signal route that connects the drains of the pair of NMOS transistors and the first current mirror circuit 3 is referred to as a pair of differential output lines 10. The first current source 8 is connected between the sources of the NMOS transistors M1, M2 and the ground line Vss.

The gate of the NMOS transistor M1 is the inverted input terminal of the differential circuit 2, and the gate of the NMOS transistor M2 is the non-inverted input terminal of the differential circuit 2. In the present embodiment, the divided voltage Vdiv input to the inverted input terminal of the differential circuit 2 is compared with the reference voltage input to the non-inverted input terminal; a comparison signal corresponding to the voltage difference between them is input to the gate of the output-stage transistor 5, and the output voltage Vout is feedback controlled.

The broadband control transistor 7 and the second current source 9 are connected in series between one of the pair of differential output lines 10 and the ground line Vss. More specifically, the drain of the broadband control transistor 7 is connected to one of the differential output lines, and its source is connected to one end of the second current source 9. Also, the divided voltage Vdiv is input to the gate of the broadband control transistor 7. As a result, the broadband control transistor 7 amplifies the high frequency signal superposed on the output voltage Vout, and the obtained signal is sent to one of the pair of differential output lines 10. The second current source 9 is connected between the source of the broadband control transistor 7 and the ground line Vss, and the phase compensating capacitor Ci1 is connected in parallel with the second current source 9.

The phase compensating capacitor Ci1 accumulates the charge as a result of the high frequency signal that is superposed on the output voltage Vout, and controls the current flowing in one of the pair of differential output lines 10 via the broadband control transistor 7 in accordance with the accumulated charge quantity.

The other line of the pair of differential output lines 10 is connected to the gate of the output-stage transistor 5. The input voltage VIN is supplied to the source of the output-stage transistor 5, and its drain is connected to the output voltage line Vout. Also, the phase compensating circuit 4 is connected between the source and gate of the output-stage transistor 5. It should be recognized that this phase compensating circuit 4 is optional, and may be omitted. This phase compensating circuit 4 has a capacitor Ci2 and a resistor R3 connected in series.

In the following, the operation of the LDO regulator 1 shown in FIG. 2 will be explained. First of all, the DC operation of the LDO regulator 1 will be explained. Here, the differential circuit 2 generates a comparison signal corresponding to the voltage difference between the reference voltage Vref and the divided voltage Vdiv of the output voltage Vout. This comparison signal is input to the gate of the output-stage transistor 5. The input voltage VIN is fed to the source of the output-stage transistor 5, and the output voltage Vout is output from the drain. Consequently, by means of the comparison signal, it is possible to change the resistance between the drain and source of the output-stage transistor 5. As a result, it is possible to control the voltage level of the output voltage Vout by means of Input voltage VIN.

For example, if the divided voltage Vdiv of the output voltage Vout is higher than the reference voltage Vref, the gate voltage of the output-stage transistor 5 becomes higher, and the resistance between the source and drain of the output-stage transistor 5, which is a PMOS transistor, becomes higher. As a result, the output voltage Vout and the divided voltage Vdiv of the output voltage Vout becomes lower.

In the following, the AC operation of the LDO regulator 1 will be explained. When a high frequency signal is superposed on the output voltage Vout due to variation in the load, charge is accumulated in the phase compensating capacitor Ci1 via the broadband control transistor 7. This charge accumulation operation is carried out instantly. Also, the speedup capacitor Cs is connected to the two ends of the resistor R1 in the voltage dividing circuit 6, so that the high frequency signal superposed on the output voltage Vout is instantly transferred to the gate of the broadband control transistor 7.

As the charge is accumulated in the phase compensating capacitor Ci1, the drain current of the broadband control transistor 7 instantly rises, and the drain current of the NMOS transistor M2 also rises. Because the first current mirror circuit 3 is connected to the drains (a pair of differential output lines) of the NMOS transistors M1, M2, an increase in the drain current of the NMOS transistor M2 leads to an increase in the drain current of the NMOS transistor M1. As a result, the gate voltage of the output-stage transistor 5 rises and the current between the source and the drain of the output-stage transistor 5 falls, so that a variation of the output voltage is suppressed.

As a result, for the LDO regulator 1 shown in FIG. 2, when a high frequency signal is superposed on the output voltage Vout, control is carried out to suppress the high frequency signal. This control can be carried out very quickly, so that a broader band can be realized.

In the LDO regulator 1 shown in FIG. 2, among the pair of transistors M1, M2 in the differential circuit 2, only one transistor M2 on the inverted input side is connected with the broadband control transistor 7, the second current source 9 and the phase compensating capacitor Ci1, so that the differential circuit 2 has an asymmetric circuit configuration. Consequently, when the pair of transistors M1, M2 are formed with the same size, a high offset voltage is generated at the output voltage Vout.

Consequently, for offset adjustment, it is preferred that the ratio of the size of transistors M1, M2 be adjusted, or the ratio of the size of the pair of transistors M3, M4 in the first current mirror circuit 3 be adjusted.

For the LDO regulator 1 shown in FIG. 2, the output capacitor Cout and the phase compensating capacitor Ci1 each have one end connected to the ground line Vss. However, it is optional to connect the one end to the ground line Vss; one may also adopt a scheme in which the one end is connected to a stable voltage route with a low impedance.

In this way, according to Embodiment 1, because the broadband control transistor 7, the phase compensating capacitor Ci1 and the second current source 9 are arranged on the inverted input side of the differential circuit 2 in the LDO regulator 1, the high frequency signal superposed on the output voltage Vout can be instantly fed back and suppressed to the gate of the output-stage transistor 5, so that a broader band can be realized for the LDO regulator 1.

According to the present embodiment, by adjusting the various element parameters of the broadband control transistor 7, the phase compensating capacitor Ci1, and the second current source 9, so that the circuit is free from the risk of oscillation, it is possible to use a ceramic capacitor as the output capacitor Cout without the phase compensating circuit 4. Although the ceramic capacitor has a problem that ESR with an effect on phase compensation is small, there is no need to perform phase compensation by the output capacitor Cout because the circuit has been set up to be free from the risk of oscillation; also, the ceramic capacitor does not pose a fire hazard that would be present for the tantalum capacitor and electrolytic capacitor, and it has less of a ripple component, so that it has better reliability and improved electrical characteristics. In addition, as mentioned previously, since the phase compensating circuit 4 can be omitted, the circuit constitution becomes simpler and the cost of the parts can be cut as well.

(Embodiment 2)

In Embodiment 2 to be explained below, as a characteristic feature, the connection destination of the gate of the broadband control transistor 7 is different from that in Embodiment 1.

Figure 3:
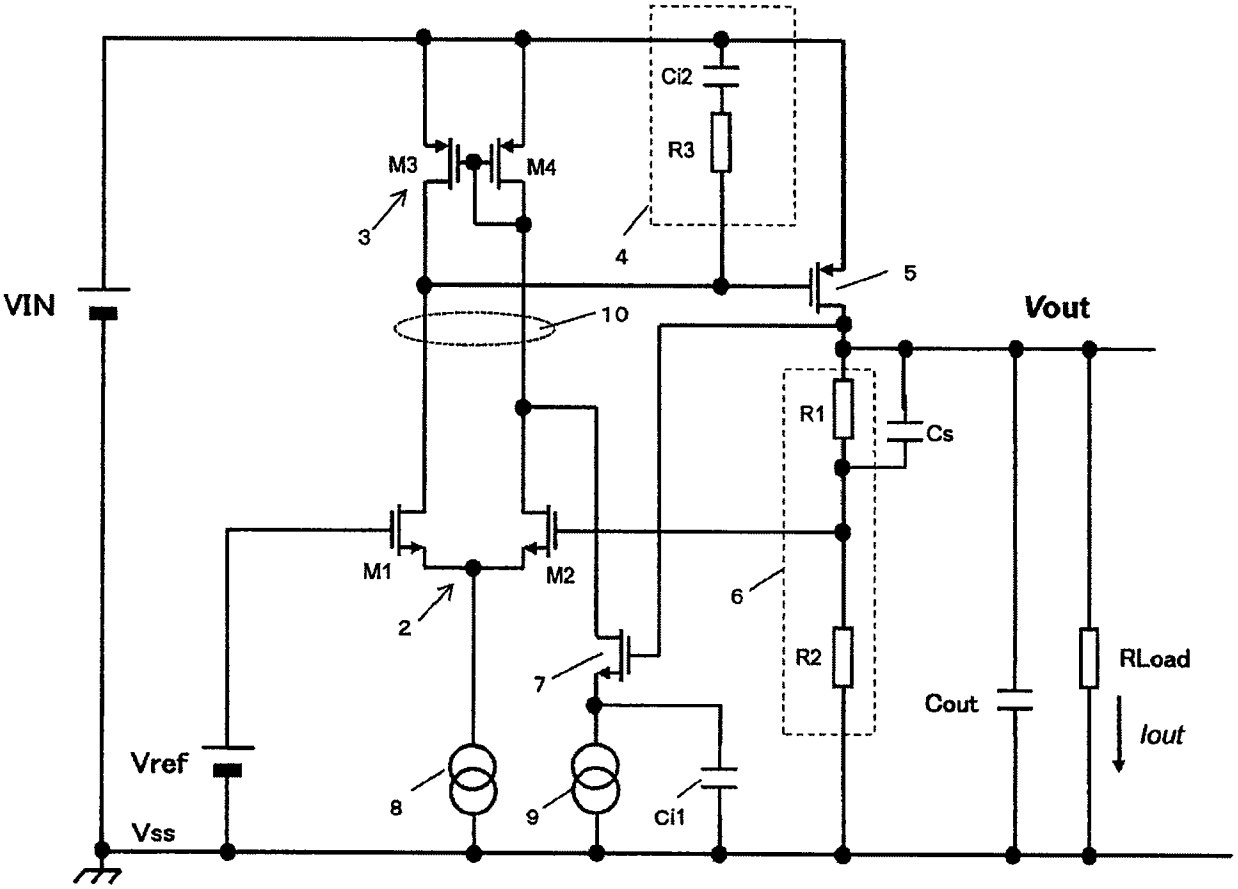
FIG. 3 is a circuit diagram illustrating the internal constitution of an LDO regulator according to a second embodiment.

FIG. 3 is a circuit diagram illustrating the internal constitution of the LDO regulator 1 related to Embodiment 2. The same keys as those in the above in FIG. 2 are adopted in FIG. 3 and, in the following, only the different features will be explained.

The gate of the broadband control transistor 7 in the LDO regulator 1 shown in FIG. 3 is set at the output voltage Vout.

A comparison between FIG. 2 and FIG. 3 indicates that for the scheme shown in FIG. 2, the voltage between the second current source 9 and the source of broadband control transistor 7, and the voltage between the first current source 8 and the differential circuit 2, have a better relative precision. On the other hand, for the scheme shown in FIG. 3, there is the effect that the high frequency signal superposed on the output voltage Vout can be directly transferred to the gate of the broadband control transistor 7. That is, the schemes shown in FIG. 2 and FIG. 3 have other respective advantages and disadvantages.

Just as shown in FIG. 2, in the case of the LDO regulator 1 shown in FIG. 3, in order to adjust the offset, it is preferred that the size ratio of the transistors M1, M2 be changed, or the size ratio of the pair of transistors M3, M4 in the first current mirror circuit 3 be changed.

In the LDO regulator 1 shown in FIG. 3, instead of connecting one end of each of the output capacitor Cout and the phase compensating capacitor Ci1 to the ground line Vss, they may also be connected to a stable voltage route with a low impedance. In addition, the phase compensating circuit 4 also can be omitted.

(Embodiment 3)

Embodiment 3 to be explained below has a characteristic feature that the inverted input side and the non-inverted input side of the differential circuit 2 have a symmetric configuration.

Figure 4:
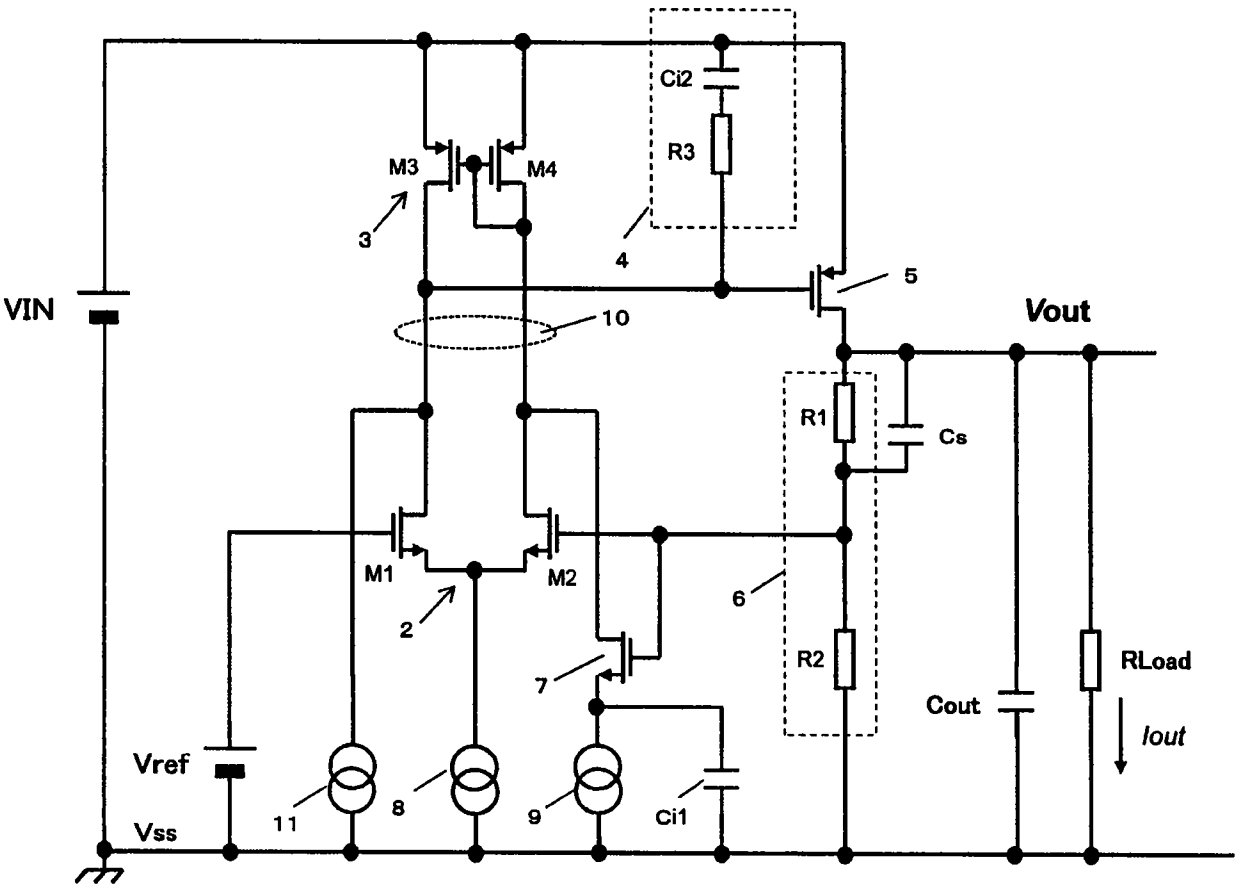
FIG. 4 is a circuit diagram illustrating the internal constitution of an LDO regulator according to a third embodiment.

FIG. 4 is a circuit diagram illustrating the internal constitution of the LDO regulator 1 according to Embodiment 3. The same reference numbers as those in FIG. 2 above are used in FIG. 4 when referring to the same features, and only the different features will be explained below.

The LDO regulator 1 shown in FIG. 4 has a third current source 11 connected between the drain of the NMOS transistor M1 in the differential circuit 2 and the ground line Vss.

Because of the symmetric configuration, it is preferred that the third current source 11 have the same electric characteristics as those of the second current source 9. As a result, it is possible to have the voltage between the third current source 11 and the drain of the NMOS transistor M1, the voltage of the route between the second current source 9 and the source of the broadband control transistor 7, and the voltage of the route between the first current source 8 and the sources of NMOS transistors M1, M2 uniform with respect to each other. As a result, it is possible to have a high relative precision for the first current source 8, second current source 9 and third current source 11. In addition, since the symmetry of the differential circuit 2 is improved, it is possible to decrease the offset voltage of the output voltage Vout.

In the LDO regulator 1 shown in FIG. 4, instead of connecting one end of each of the output capacitor Cout and the phase compensating capacitor Ci1 to the ground line Vss, one may also adopt a scheme in which they are connected to a stable voltage route with a low impedance. In addition, the phase compensating circuit 4 may be omitted.

As shown in FIG. 4, the third current source 11 is added to the LDO regulator 1 shown in FIG. 2. However, one may also adopt a scheme in which the third current source 11 is added to the LDO regulator 1 shown in FIG. 3 to form a symmetric configuration.

(Embodiment 4)

In Embodiment 4 to be explained below, the same transistor as the broadband control transistor 7 is also set on the non-inverted input side of the differential circuit 2, and the offset voltage of the output voltage Vout is decreased.

Figure 5:
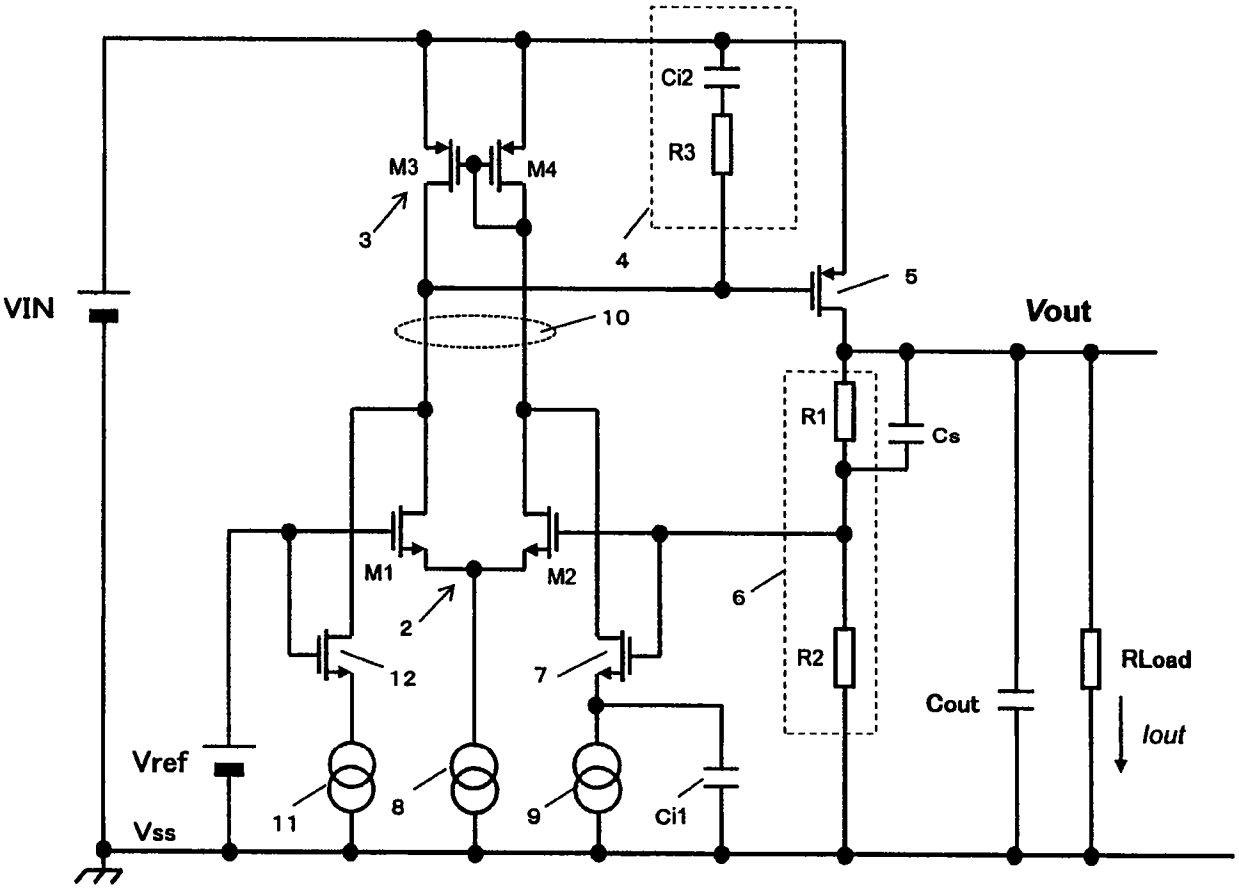
FIG. 5 is a circuit diagram illustrating the internal constitution of an LDO regulator according to a fourth embodiment.

FIG. 5 is a circuit diagram illustrating the internal constitution of the LDO regulator 1 according to Embodiment 4. For the LDO regulator 1 shown in FIG. 5, in addition to the constitution shown in FIG. 4, it also has an NMOS transistor 12 connected between the third current source 11 and the drain of the NMOS transistor M1. The drain of the NMOS transistor 12 is connected to the drain of the NMOS transistor M1 and the source of the NMOS transistor 12 is connected to the third current source 11. The gate of the NMOS transistor 12 is set at the reference voltage Vref, and it is also connected to the gate of the NMOS transistor M1.

Because the gate voltage of the NMOS transistor 12 is at the reference voltage Vref, the source voltage also becomes a voltage corresponding to the reference voltage Vref, and it is possible to realize a constant voltage for the voltage of the connecting route between the third current source 11 and the NMOS transistor 12. As a result, it is possible to improve the symmetry of the differential circuit 2, and it is possible to decrease the offset voltage of the output voltage Vout.

For the LDO regulator 1 shown in FIG. 5, it is preferred that the second current source 9 and the third current source 11 have the same electric characteristics, and that the broadband control transistor 7 and the NMOS transistor 12 also have the same electric characteristics.

Also, in the LDO regulator 1 shown in FIG. 5, instead of connecting one end of each of the output capacitor Cout and the phase compensating capacitor Ci1 to the ground line Vss, one may also adopt a scheme in which they are connected to a stable voltage route with a low impedance. In addition, the phase compensating circuit 4 may be omitted.

As shown in FIG. 5, the NMOS transistor 12 is added to the LDO regulator 1 shown in FIG. 4. However, one may also adopt a scheme in which the third current source 11 and the NMOS transistor 12 are added to the LDO regulator 1 to have a symmetric configuration shown in FIG. 3.

(Embodiment 5)

In Embodiment 5 to be explained below, it is possible to perform fine adjustment of the phase margin.

Figure 6:
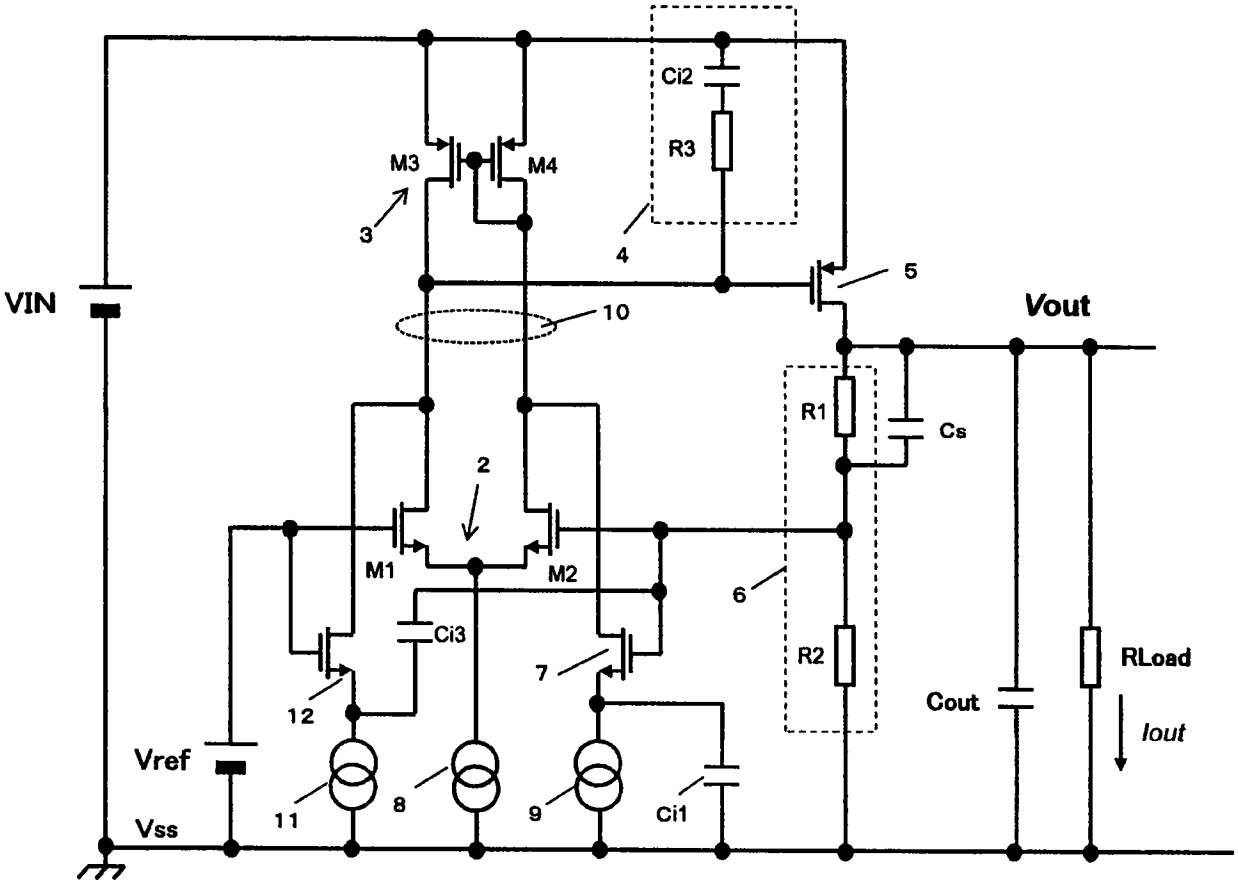
FIG. 6 is a circuit diagram illustrating the internal constitution of an LDO regulator according to a fifth embodiment.

FIG. 6 is a circuit diagram illustrating the internal constitution of the LDO regulator 1 according to Embodiment 5. The same reference numbers as those in the above in FIG. 5 are used in FIG. 6 when referring to the same features and, in the following, only the different features will be explained.

In the LDO regulator 1 shown in FIG. 6, in addition to the constitution shown in FIG. 5, there is a phase compensating capacitor Ci3 (third capacitor) connected between the gate of the broadband control transistor 7 and the source of the NMOS transistor 12. The capacitance of the phase compensating capacitor Ci3 should be selected to be much smaller than the capacitance of the phase compensating capacitor Ci1, such as a capacitance value smaller by two or more orders of magnitude than that of the latter. By arranging the phase compensating capacitor Ci3, it is possible to perform fine adjustment of the phase margin.

Figure 7:
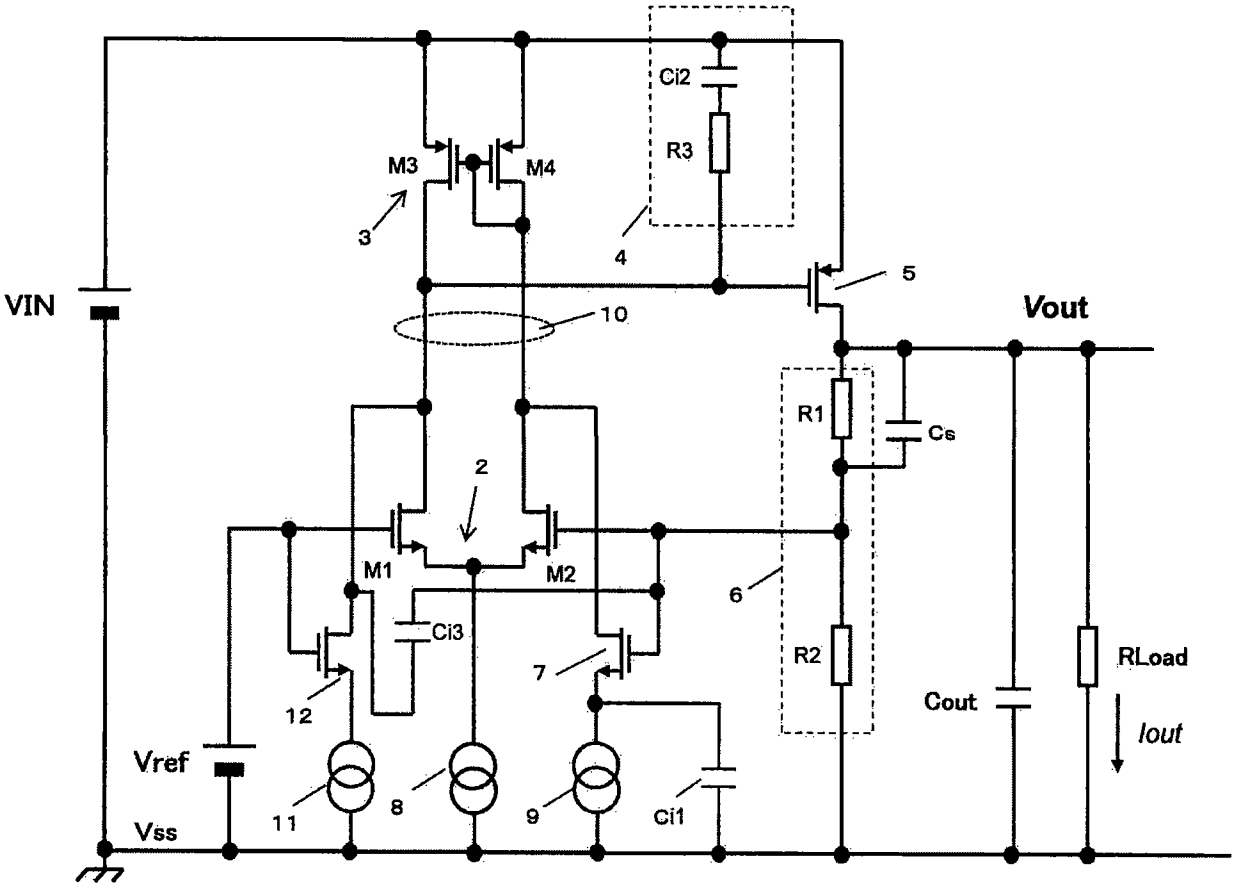
FIG. 7 is a circuit diagram illustrating a modified example related to FIG. 6.

FIG. 7 is a circuit diagram illustrating a modified circuit of FIG. 6. Here, one end of the phase compensating capacitor Ci3 is connected to the drain of the NMOS transistor 12 instead of its source. Just as in FIG. 6, in the case of FIG. 7, too, by arranging a phase compensating capacitor Ci3, it is possible to perform fine adjustment of the phase margin.

For the LDO regulator 1 shown in FIG. 6 and FIG. 7, it is preferred that the second current source 9 and the third current source 11 have the same electrical characteristics, and that the broadband control transistor 7 and the NMOS transistor 12 have the same electrical characteristics. In addition, instead of connecting one end of each of the output capacitor Cout and the phase compensating capacitor Ci1 to the ground line Vss, one may also adopt a scheme in which they are connected to a stable voltage route with a low impedance. In addition, the phase compensating circuit 4 may be omitted.

As shown in FIG. 6 and FIG. 7, the phase compensating capacitor Ci3 is added to the LDO regulator 1 shown in FIG. 5. However, one may also adopt a scheme in which a phase compensating capacitor Ci3 for fine adjustment of the phase margin is added to all of the LDO regulators 1 having the third current source 11.

(Embodiment 6)

In Embodiment 6 to be explained below, the differential circuit 2 has a folded cascade type of configuration.

In the LDO regulator 1 shown in FIG. 1 through FIG. 7, as an example, the differential circuit 2 includes a pair of NMOS transistors M1, M2. However, when the input voltage VIN becomes as low as 1.5 V or lower, the reference voltage Vref also decreases, so that the NMOS transistor cannot be used in the differential circuit 2. In such a case, one may adopt a constitution in which the differential circuit 2 has a folded cascade type of constitution, in which a pair of PMOS transistors M1, M2 are set.

Figure 8:
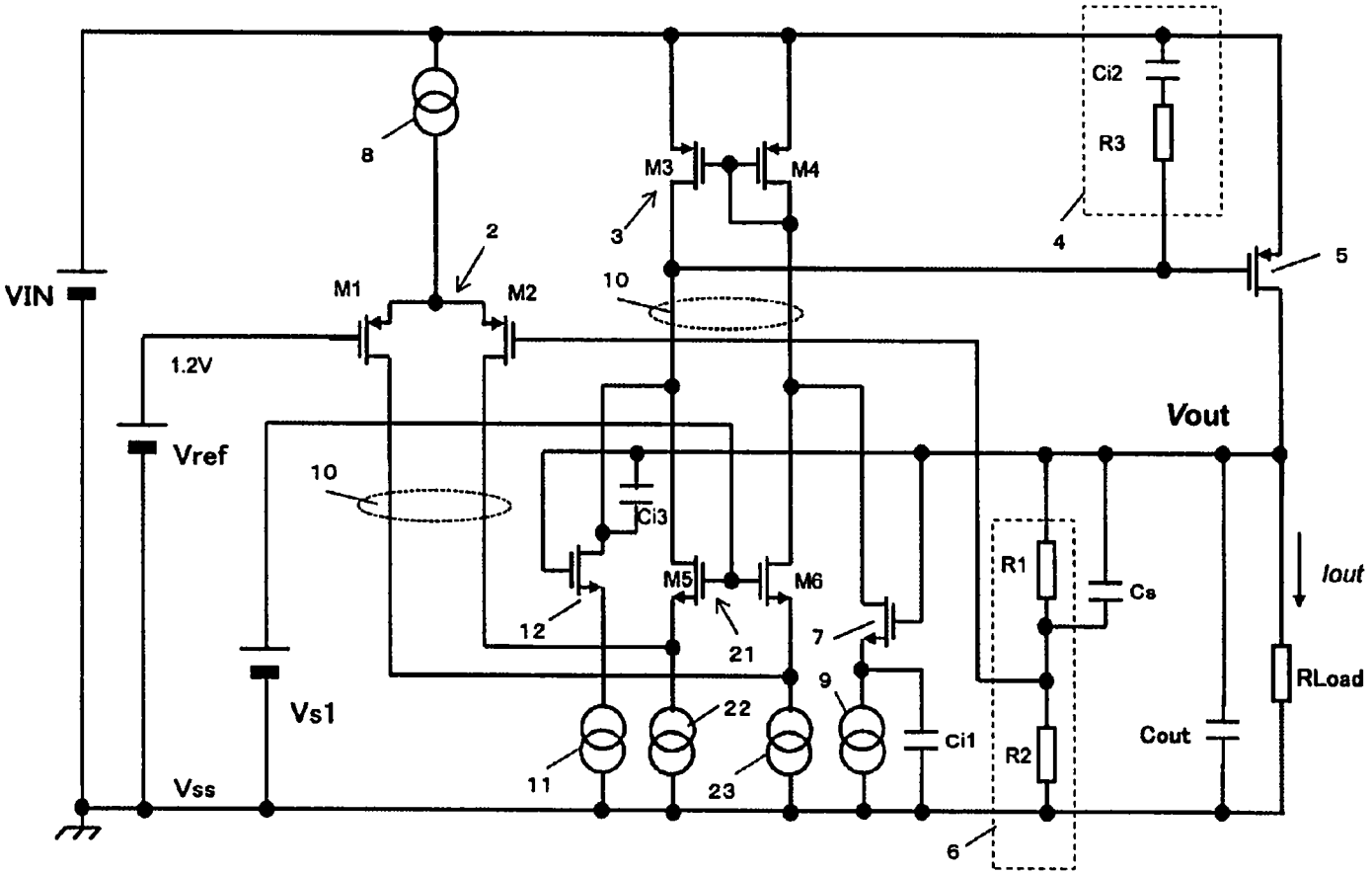
FIG. 8 is a circuit diagram illustrating the internal constitution of an LDO regulator according to a sixth embodiment.

FIG. 8 is a circuit diagram illustrating the internal constitution of the LDO regulator 1 according to Embodiment 6. The same reference numbers as those in the above in FIG. 7 are used in FIG. 8 when referring to the same features and, in the following, only the different features will be explained.

The differential circuit 2 in the LDO regulator 1 shown in FIG. 8 has a folded cascade type of constitution, and it has a pair of PMOS transistors M1, M2. A second current mirror circuit 21 including a pair of NMOS transistors M5, M6 is connected between the differential circuit 2 and the first current mirror circuit 3 including a pair of PMOS transistors M3, M4. The pair of differential output lines 10 of the second current mirror circuit 21 are connected to a fourth current source 22 and a fifth current source 23.

The broadband control transistor 7 and the second current source 9 are connected in series between one line of the pair of differential output lines 10 between the first current mirror circuit 3 and second current mirror circuit 21 and the ground line Vss, and the phase compensating capacitor Ci1 is connected in parallel with the second current source 9.

The NMOS transistor 12 and the third current source 11 are connected in series between the other line of the pair of differential output lines 10 and the ground line Vss. The phase compensating capacitor Ci1 for fine adjustment of the phase margin is connected between the drain of the NMOS transistor 12 and the output voltage line Vout.

Because the pair of PMOS transistors M1, M2 are set in the differential circuit 2, even when the reference voltage Vref is a constant voltage of about 1.2 V, it is still possible to perform the comparison operation free of problems, and it is possible to generate a low voltage as the output voltage line Vout.

One end of each of the second through fifth current sources 9, 11, 22 and 23, one end of the phase compensating capacitor Ci1, one end of the voltage dividing circuit 6, and one end of the output capacitor Cout are all connected to the ground line Vss. Also, one end of the first current source 8, one end of the first current mirror circuit 3, one end of the phase compensating circuit 4, and the source of the output-stage transistor 5 are all connected to the input voltage VIN.

Figure 9:
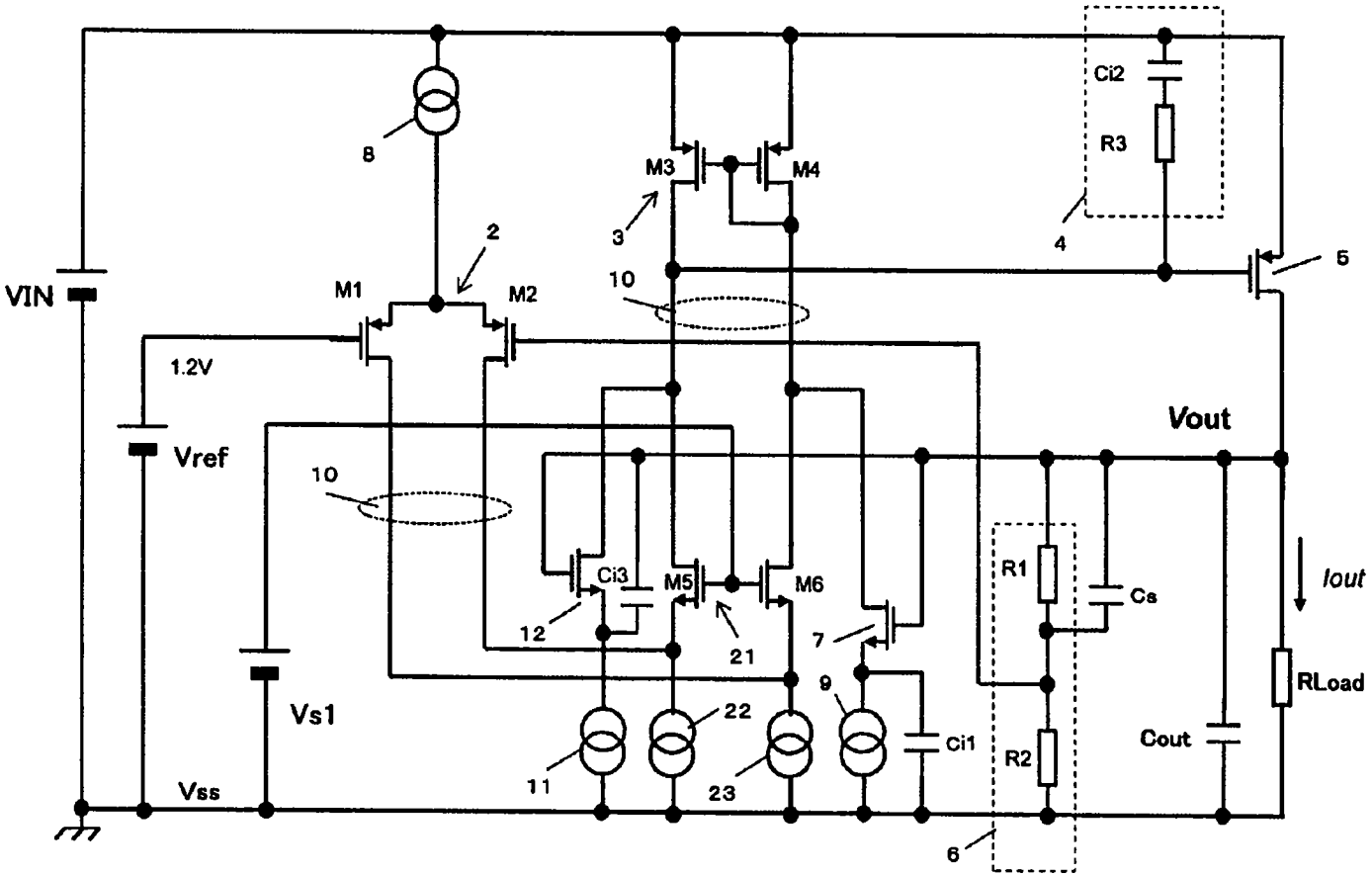
FIG. 9 is a circuit diagram illustrating a modified LDO regulator of FIG. 8.

FIG. 9 is a circuit diagram illustrating a modified example of FIG. 8. The LDO regulator 1 shown in FIG. 9 has the characteristic feature that one end of the phase compensating capacitor Ci1 for fine adjustment of the phase margin is connected to the source of the NMOS transistor 12 instead of its drain.

Just as in FIG. 8, for the LDO regulator 1 shown in FIG. 9, because it has the folded cascade type of constitution, a stable operation can be performed even when the input voltage VIN is a low voltage.

For the LDO regulator 1 shown in FIG. 8 and FIG. 9, it is preferred that the second current source 9 and the third current source 11 have the same electric characteristics, the fourth current source 22 and the fifth current source 23 have the same electrical characteristics, and the broadband control transistor 7 and the NMOS transistor 12 have the same electrical characteristics. Also, instead of connecting one end of each of the output capacitor Cout and the phase compensating capacitor Ci1 to the ground line Vss, they may also be connected to a stable voltage route with a low impedance. In addition, the phase compensating circuit 4 may be omitted.

The LDO regulator 1 shown in FIG. 8 and FIG. 9 has a phase compensating capacitor Ci3 for fine adjustment of the phase margin. However, it may also be omitted.

(Embodiment 7)

In Embodiment 7 to be explained below, the electroconductive type of the transistors in the LDO regulator 1 is inverted to that in Embodiments 1 through 6, and the circuit connection configuration is also inverted.

Figure 10:
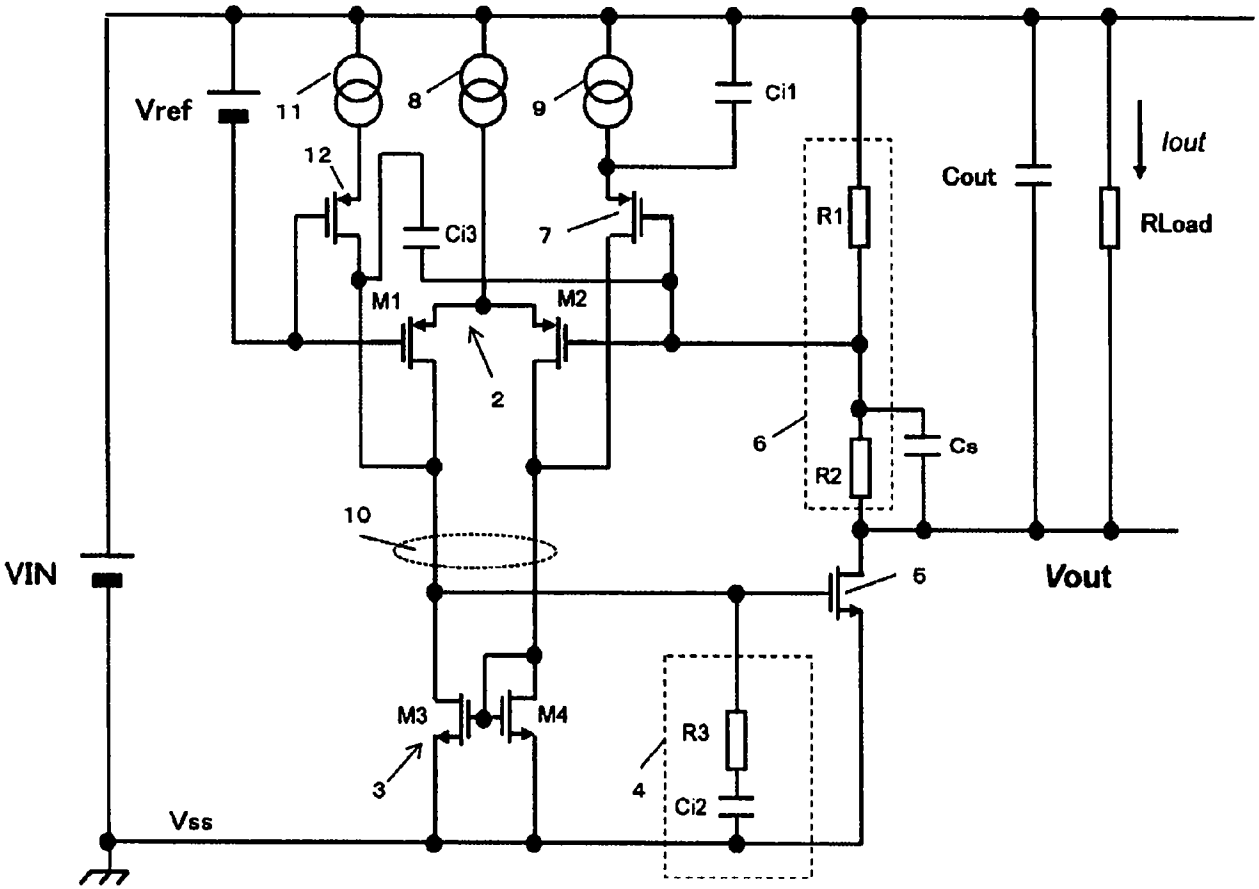
FIG. 10 is a circuit diagram illustrating the internal constitution of an LDO regulator according to a seventh embodiment.

FIG. 10 is a circuit diagram illustrating the internal constitution of the LDO regulator 1 according to Embodiment 7. The electroconductive type of the transistors in the LDO regulator 1 shown in FIG. 10 is inverted to the electroconductive type of the transistors in the LDO regulator 1 shown in FIG. 6. In addition, the connection configuration of the circuit between the input voltage line VIN and the ground line Vss is also inverted. The same keys as those for the transistors shown in FIG. 6 are adopted in FIG. 10, too, although the electroconductive type should be inverted for them.

In the LDO regulator 1 shown in FIG. 10, one end of each of the first through third current sources 8, 9, 11, one end of the phase compensating capacitor Ci1, one end of the voltage dividing circuit 6, one end of the output capacitor Cout, and one end of the load resistor Rload are all connected to the input voltage line VIN. Also, one end of the first current mirror circuit 3 including a pair of NMOS transistors M1, M2, one end of the phase compensating circuit 4, and the source of the output-stage transistor 5 are all connected to the ground line Vss.

In addition, the LDO regulator 1 shown in FIG. 10 has the following parts: the differential circuit 2 including a pair of PMOS transistors M1, M2, the broadband control transistor 7 made of PMOS transistor, the second current source 9 and the phase compensating capacitor Ci1 connected in parallel between the source of the broadband control transistor 7 and the input voltage line VIN, the PMOS transistor 12 connected to the symmetric position of the broadband control transistor 7, the third current source 11 connected between the source of the transistor 12 and the input voltage line VIN, and the phase compensating capacitor Ci1 for fine adjustment of the phase margin.

Figure 11:
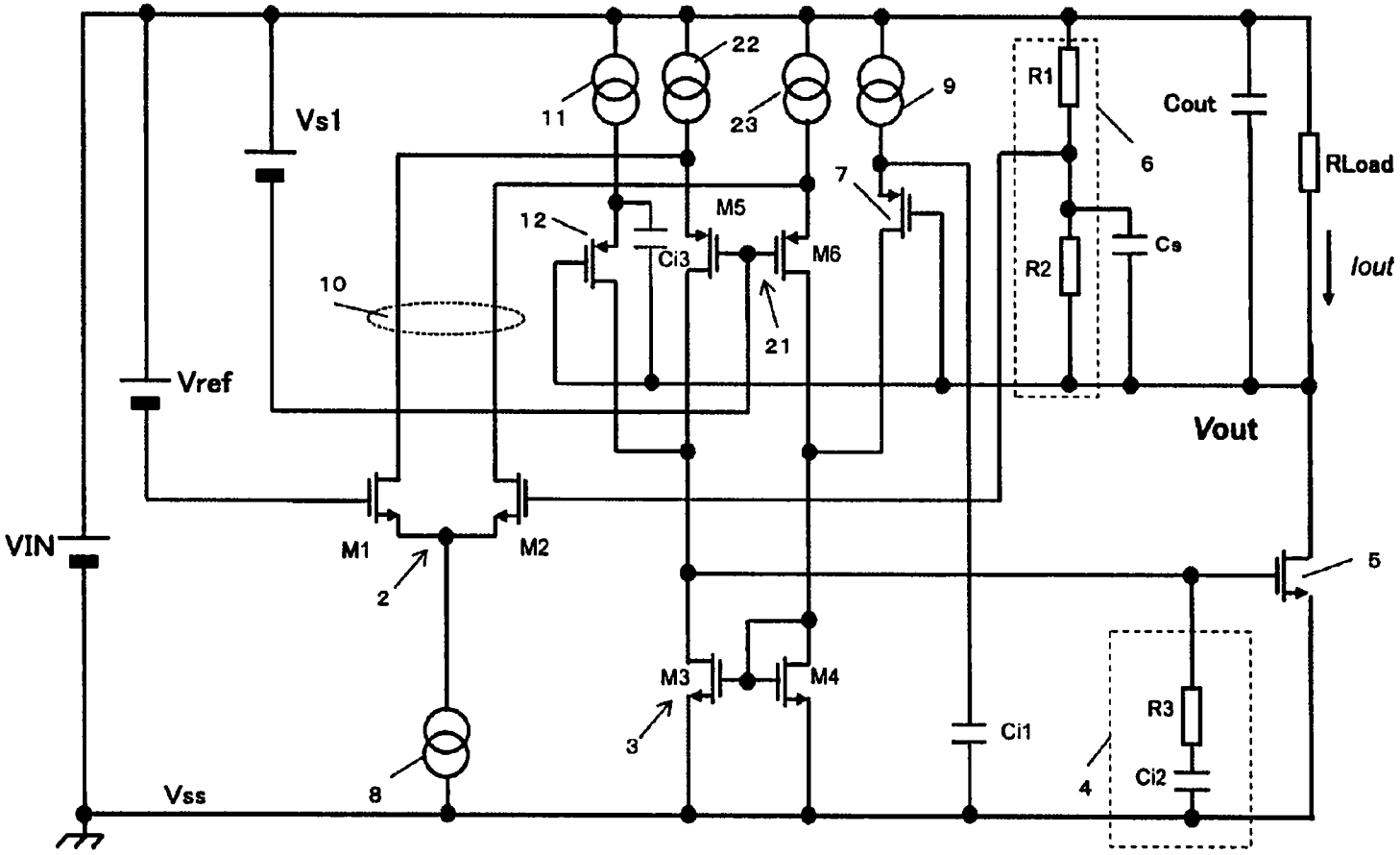
FIG. 11 is a circuit diagram illustrating a modified LDO regulator of FIG. 10.

FIG. 11 is a circuit diagram illustrating a modified example of FIG. 10. It has the differential circuit 2 of the folded cascade type. For the LDO regulator 1 shown in FIG. 11, the electroconductive type of the transistors is inverted to that of the transistors in the LDO regulator 1 shown in FIG. 8, and the connection configuration of the circuit is also inverted.

For the LDO regulator 1 shown in FIG. 11, one end of each of the second through fifth current sources 9, 11, 22, 23, one end of voltage dividing circuit 6, and one end of the output capacitor Cout are all connected to the input voltage line VIN. Also, one end of the first current source 8, one end of the first current mirror circuit 3 including a pair of NMOS transistors M3, M4, one end of the phase compensating capacitor Ci1, and one end of the phase compensating circuit 4 are connected to the ground line Vss.

The LDO regulator 1 shown in FIG. 11 has the following parts: the differential circuit 2 including a pair of NMOS transistors M1, M2, the first current source 8 connected between the differential circuit 2 and the ground line Vss, the second current mirror circuit 21 including a pair of PMOS transistors M5, M6 connected to the pair of differential output lines 10 of the differential circuit 2, the first current mirror circuit 3 including a pair of NMOS transistors M3, M4 connected to the second current mirror circuit 21, the second current source 9 and the broadband control transistor 7 connected in series between the input voltage line VIN and the drain of the PMOS transistor M6, the phase compensating capacitor Ci1 connected between the source of the broadband control transistor 7 and the ground line Vss, and the third current source 11 and the PMOS transistor 12 connected in series between the input voltage line VIN and the drain of the PMOS transistor M5.

For the LDO regulator 1 shown in FIG. 10 and FIG. 11, it is preferred that the second current source 9 and the third current source 11 have the same electric characteristics, and that the broadband control transistor 7 and the NMOS transistor 12 have the same electrical characteristics. Instead of connecting one end of each of the output capacitor Cout and the phase compensating capacitor Ci1 to the ground line Vss, one may also adopt a scheme in which they are connected to a stable voltage route with a low impedance. In addition, the phase compensating circuit 4 may be omitted.

As shown in FIG. 10, the gate of the broadband control transistor 7 may be connected to the output voltage Vout. In addition, in FIG. 10, the PMOS transistor 12 may be omitted. In addition, in FIG. 10, PMOS transistor 12 and the third current source 11 may be omitted as well. Also, in FIG. 10 and FIG. 11, the phase compensating capacitor Ci3 may also be omitted.

(Embodiment 8)

In Embodiment 8 to be explained below, the reference voltage on the low voltage side of the LDO regulator 1 is at a negative voltage level.

Figure 12:
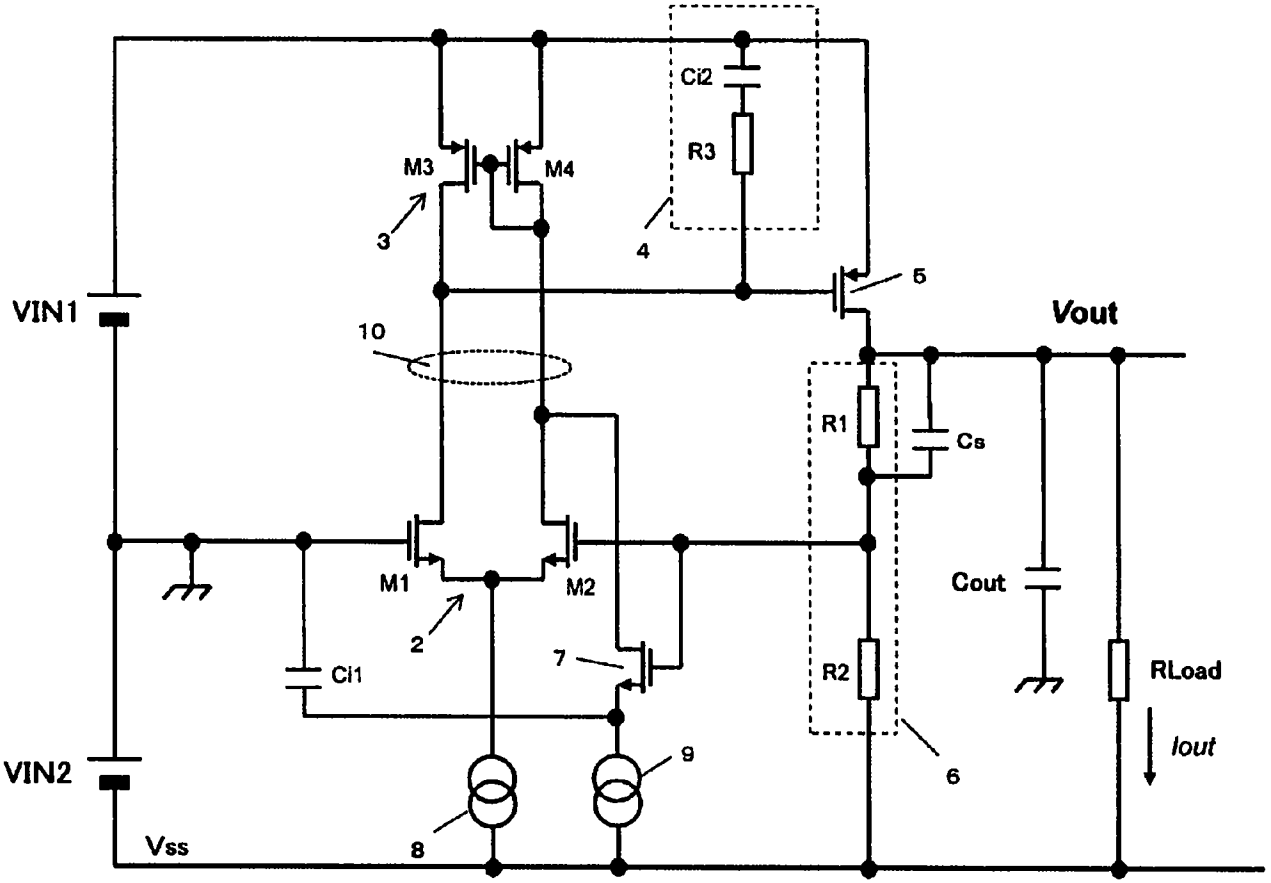
FIG. 12 is a circuit diagram illustrating an LDO regulator according to an eight embodiment.

FIG. 12 is a circuit diagram illustrating the LDO regulator 1 according to Embodiment 8. The LDO regulator 1 shown in FIG. 12 has a circuit constitution similar to that shown in FIG. 2. However, the reference voltage on the low voltage side is not the ground voltage; instead, it is a negative voltage (=−VIN2).

For the LDO regulator 1 shown in FIG. 12, two types of input voltages VIN1, VIN2 are input to it. Among them, one becomes the input voltage line VIN1 on the higher voltage side, and the other becomes the input voltage line (=−VIN2) on the lower voltage side.

The first current source 8 is connected between the differential circuit 2 including a pair of NMOS transistors M1, M2 and the negative side input voltage line (=−VIN2). The broadband control transistor 7 and the second current source 9 are connected in series between the drain of the NMOS transistor M2 and the negative side input voltage line (=−VIN2). Also, the voltage dividing circuit 6 and the load resistor Rload are connected in parallel between the output voltage line Vout and the negative side input voltage line (=−VIN2). In addition, the phase compensating capacitor Ci1 is connected between the source of the broadband control transistor 7 and the gate of the NMOS transistor M1.

Figure 13:
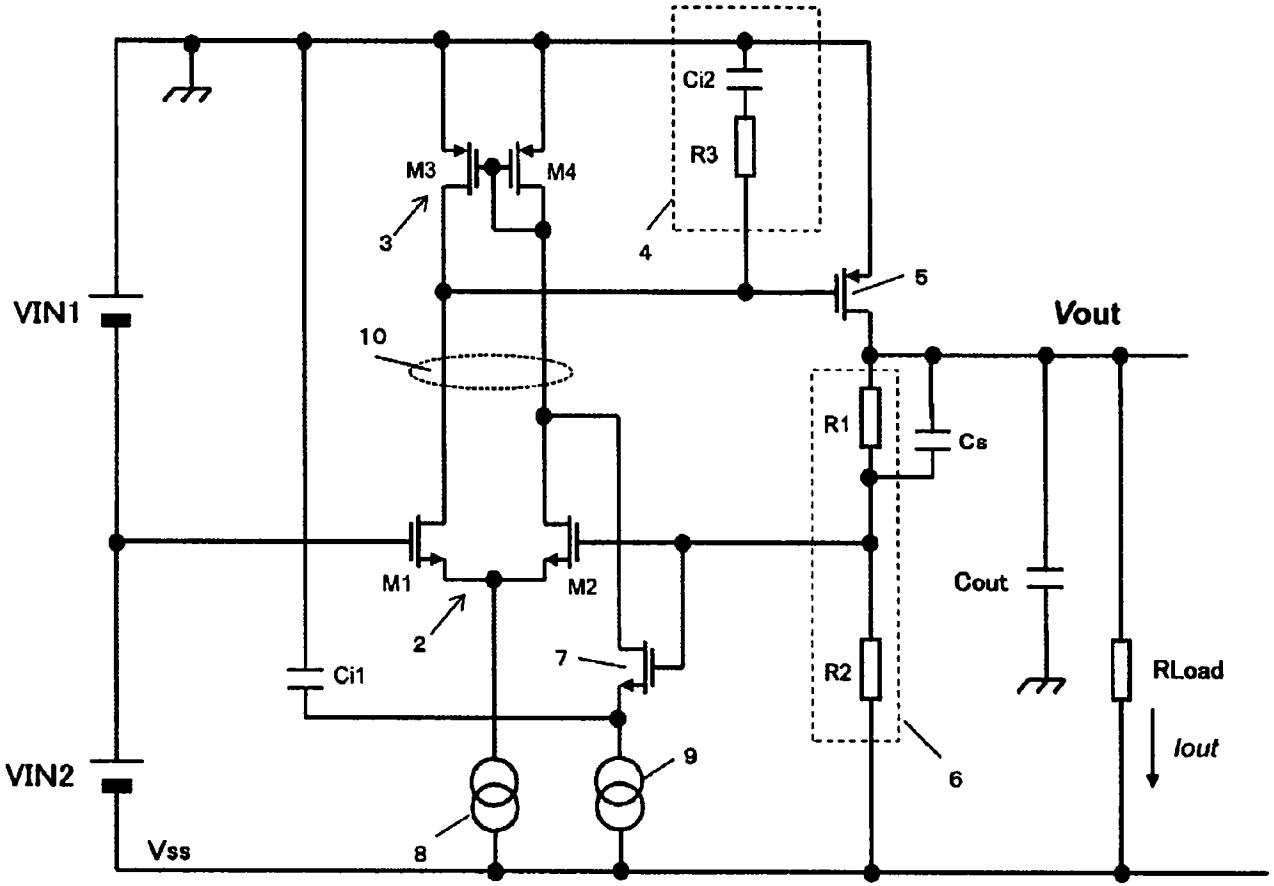
FIG. 13 is a circuit diagram illustrating a modified LDO regulator of FIG. 12.

FIG. 13 is a circuit diagram illustrating a modified example with respect to that shown in FIG. 12. The LDO regulator 1 shown in FIG. 13 differs from that shown in FIG. 12 in that one end of the phase compensating capacitor Ci1 is connected to the positive side input voltage line VIN1 instead of the gate of the broadband control transistor 6; at the same time, the positive side input voltage line VIN1 is set at the ground voltage level.

The voltage level of the negative side input voltage line of the LDO regulator 1 shown in FIG. 13 is at −(VIN1+VIN2), and the operation can be carried out at a voltage lower than that in FIG. 12.

The LDO regulator 1 shown in FIG. 12 and FIG. 13 works in the same way and has the same effects as those of the LDO regulator 1 shown in FIG. 2 except that the voltage level of the negative side input voltage line is set at a negative voltage lower than the ground voltage.

For the LDO regulator 1 shown in FIG. 12 and FIG. 13, the voltage of the negative side electrode of the output capacitor Cout and the phase compensating capacitor Ci1 may also be connected to a stable voltage route with a low impedance instead of setting at the voltage shown in FIG. 12 and FIG. 13. In addition, the phase compensating circuit 4 may be omitted.

In FIG. 12 and FIG. 13, the gate of the broadband control transistor 7 may be connected to the output voltage line Vout. In FIG. 12 and FIG. 13, the third current source 11 may be added to form a symmetric constitution just as in FIG. 4. In addition, in order to further improve the symmetry, the NMOS transistor 12 may be added just as in FIG. 5. Also, as shown in FIG. 12 and FIG. 13, the phase compensating capacitor Ci3 as shown in FIG. 6 and FIG. 7 may be added, too.

(Embodiment 9)

In Embodiment 9 to be explained below, the electroconductive type of the broadband control transistor 7 is inverted to that in Embodiment 1.

Figure 14:
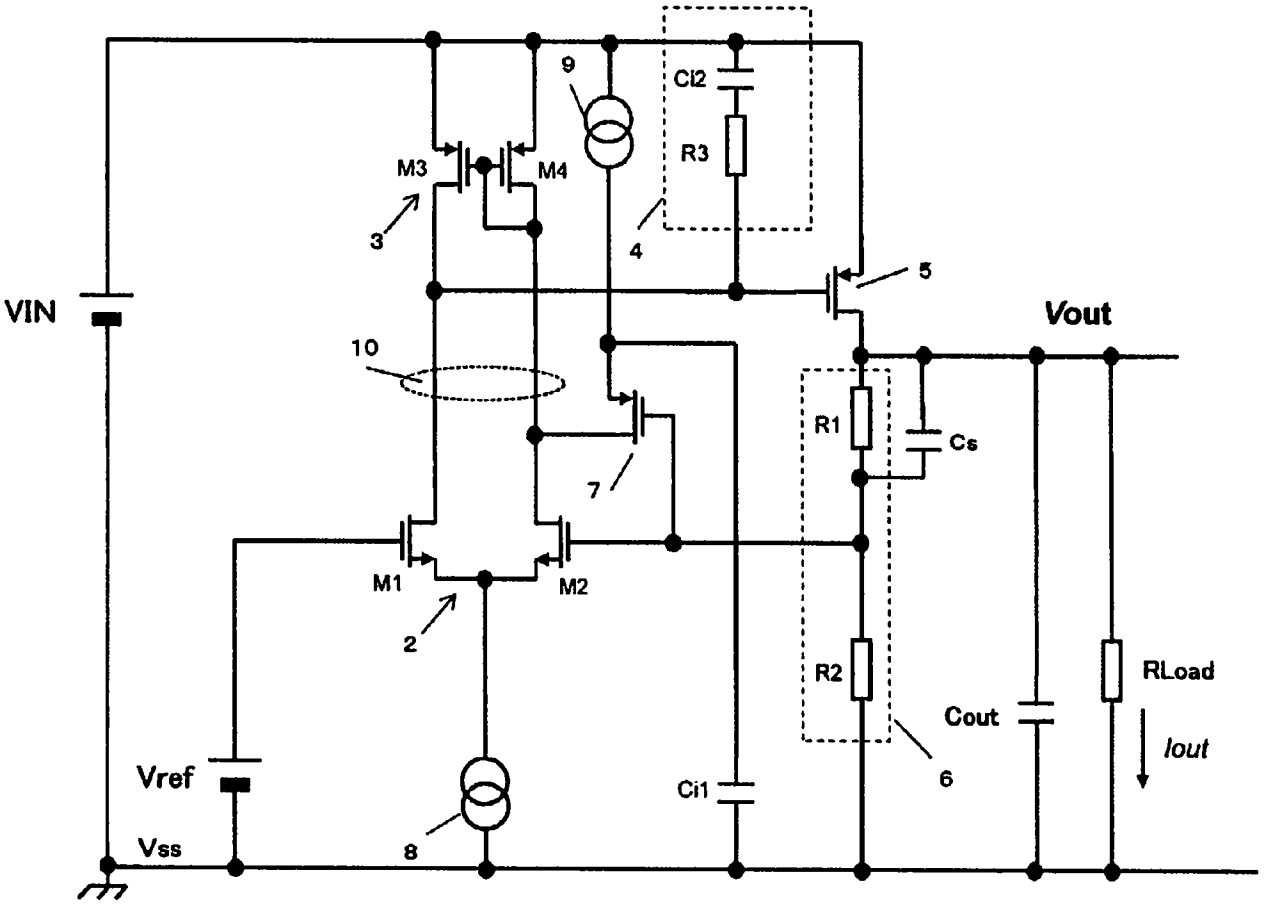
FIG. 14 is a circuit diagram illustrating an LDO regulator according to a ninth embodiment.

FIG. 14 is a circuit diagram illustrating the LDO regulator 1 according to Embodiment 9. Different from the LDO regulator 1 shown in FIG. 2, the LDO regulator 1 shown in FIG. 14 has a different connection configuration of the broadband control transistor 7, the second current source 9 and the phase compensating capacitor Ci1. The broadband control transistor 7 shown in FIG. 14 is a PMOS transistor; the second current source 9 is connected between its source and the input voltage line VIN, and a phase compensating capacitor Ci1 is connected between its source and the ground line Vss.

In this way, even when the broadband control transistor 7 is made of a PMOS transistor, the same effect in forming a broader band as in FIG. 2 can be realized.

Just as in FIG. 2, in the case of the LDO regulator 1 shown in FIG. 14, too, in order to adjust the offset, it is preferred that the size ratio of the transistors M1, M2 or the size ratio of the pair of transistors M3, M4 in the current mirror circuit 3 be changed.

In addition, for the LDO regulator 1 shown in FIG. 14, instead of connecting one end of the output capacitor Cout and the phase compensating capacitor Ci1 to the ground lines Vss, they may also be connected to a stable voltage route with a low impedance. In addition, the phase compensating circuit 4 may be omitted.

Similarly, the broadband control transistor 6 made of NMOS transistor explained in the aforementioned embodiments may be substituted by a PMOS transistor.

Figure 15:
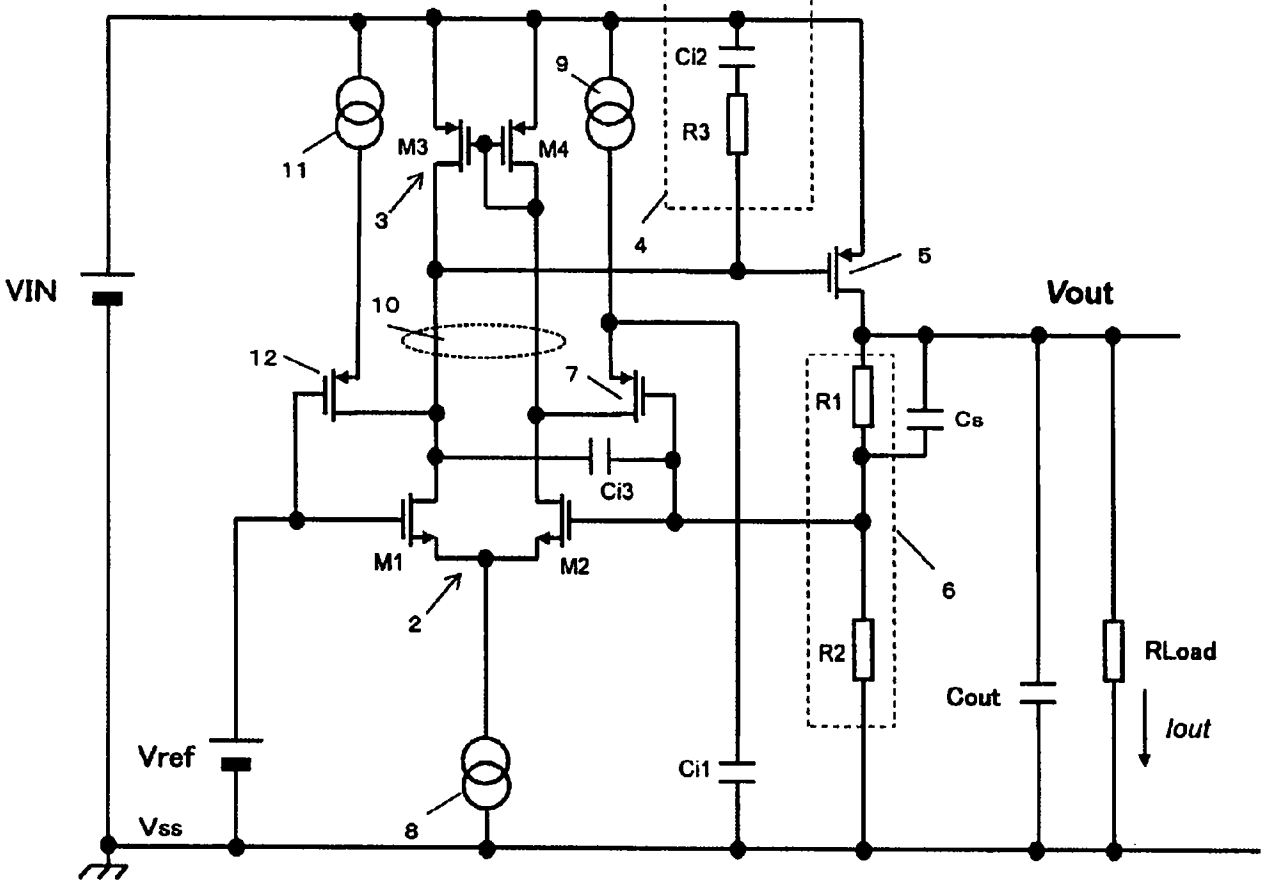
FIG. 15 is a circuit diagram illustrating a modified LDO regulator of FIG. 6.

FIG. 15 is a circuit diagram illustrating a modified example with respect to FIG. 6. The LDO regulator 1 shown in FIG. 15 has the following parts: the second current source 9 and the broadband control transistor 7 connected in parallel between the input voltage line VIN and the gate of the NMOS transistor M2, the third current source 11 and the PMOS transistor 12 connected in series between the input voltage line VIN and the gate of the NMOS transistor M1, and the phase compensating capacitor Ci1 connected between the drain of the NMOS transistor M1 and the gate of the NMOS transistor M2. The gate of the broadband control transistor 7 is connected to the gate of the NMOS transistor M2, and the gate of the PMOS transistor 12 is connected to the gate of the NMOS transistor M1.

For the LDO regulator 1 shown in FIG. 15, it is preferred that the second current source 9 and the third current source 11 have the same electrical characteristics, and that the broadband control transistor 7 and the PMOS transistor 12 have the same electrical characteristics. Also, instead of connecting of an end of each of the output capacitor Cout and the phase compensating capacitor Ci1 to the ground line Vss, they may also be connected to a stable voltage route with a low impedance. In addition, the phase compensating circuit 4 may be omitted.

As shown in FIG. 14 and FIG. 15, the gate of the broadband control transistor 7 may also be connected to the output voltage line Vout. Also, as shown in FIG. 15, the PMOS transistor 12 may be omitted. Also, as shown in FIG. 15, the connecting site of the phase compensating capacitor Ci3 is not limited to that shown in the figure, and the phase compensating capacitor Ci3 may be added in FIG. 14.

Figure 16:
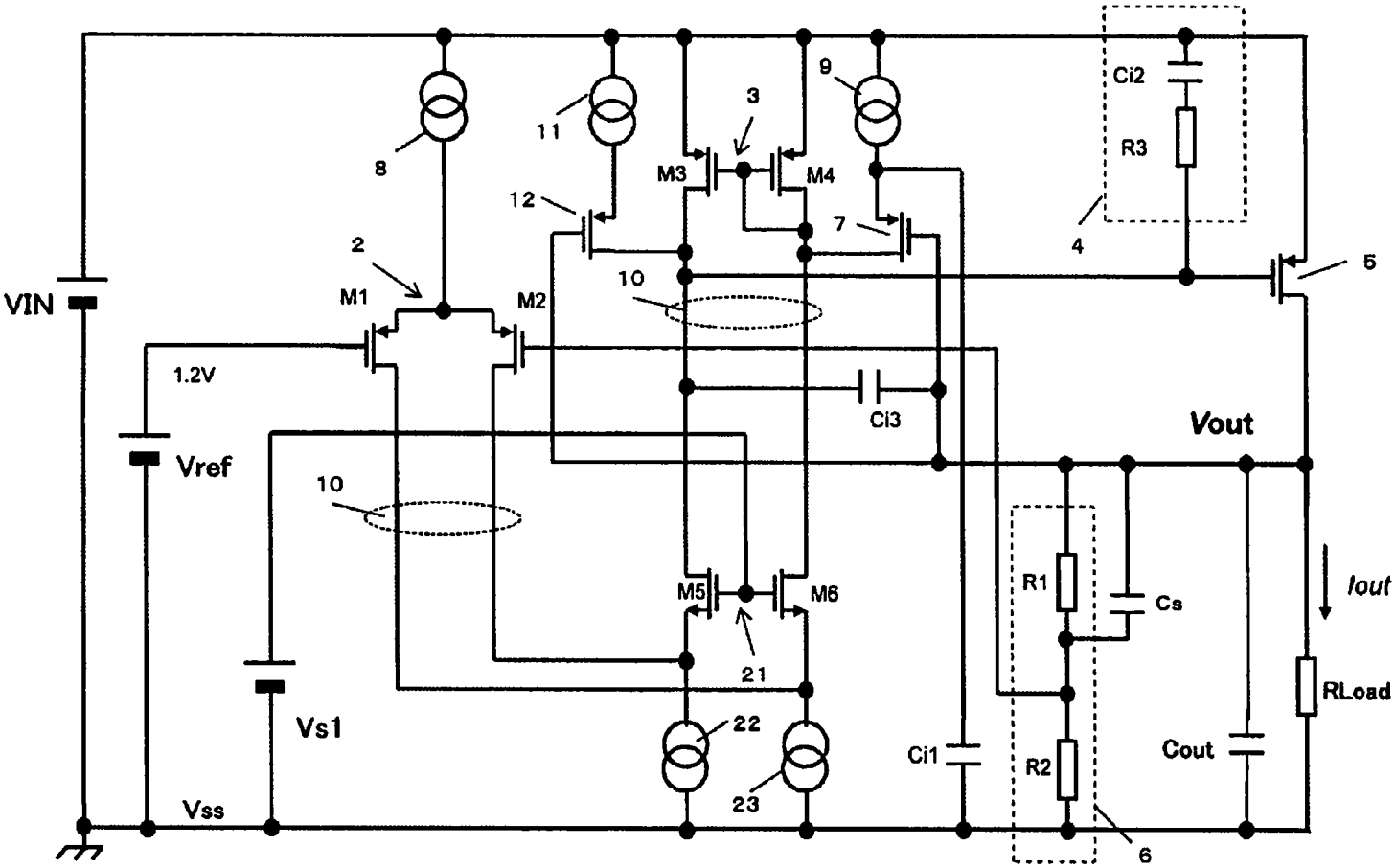
FIG. 16 is a circuit diagram illustrating a modified LDO regulator of FIG. 8.

FIG. 16 is a circuit diagram illustrating a modified example with respect to FIG. 8. The LDO regulator 1 shown in FIG. 16 has a folded cascade type of constitution. The second current source 9 and the broadband control transistor 7 are connected in series between the input voltage line VIN and the drain of the PMOS transistor M4. The third current source 11 and the PMOS transistor 12 are connected in series between the input voltage line VIN and the drain of the PMOS transistor M3. The phase compensating capacitor Ci1 is connected between the source of the broadband control transistor 7 and the ground line Vss. The phase compensating capacitor Ci3 is connected between the drain of the PMOS transistor M3 and the gate of the broadband control transistor 7.

In the LDO regulator 1 shown in FIG. 16, it is preferred that the second current source 9 and the third current source 11 have the same electrical characteristics, the fourth current source 22 and the fifth current source 23 have the same electrical characteristics, and the broadband control transistor 7 and the NMOS transistor 12 have the same electrical characteristics. Also, instead of connecting one end of each of the output capacitor Cout and the phase compensating capacitor Ci1 to the ground line Vss, they may also be connected to a stable voltage route with a low impedance. In addition, the phase compensating circuit 4 may be omitted.

Figure 17:
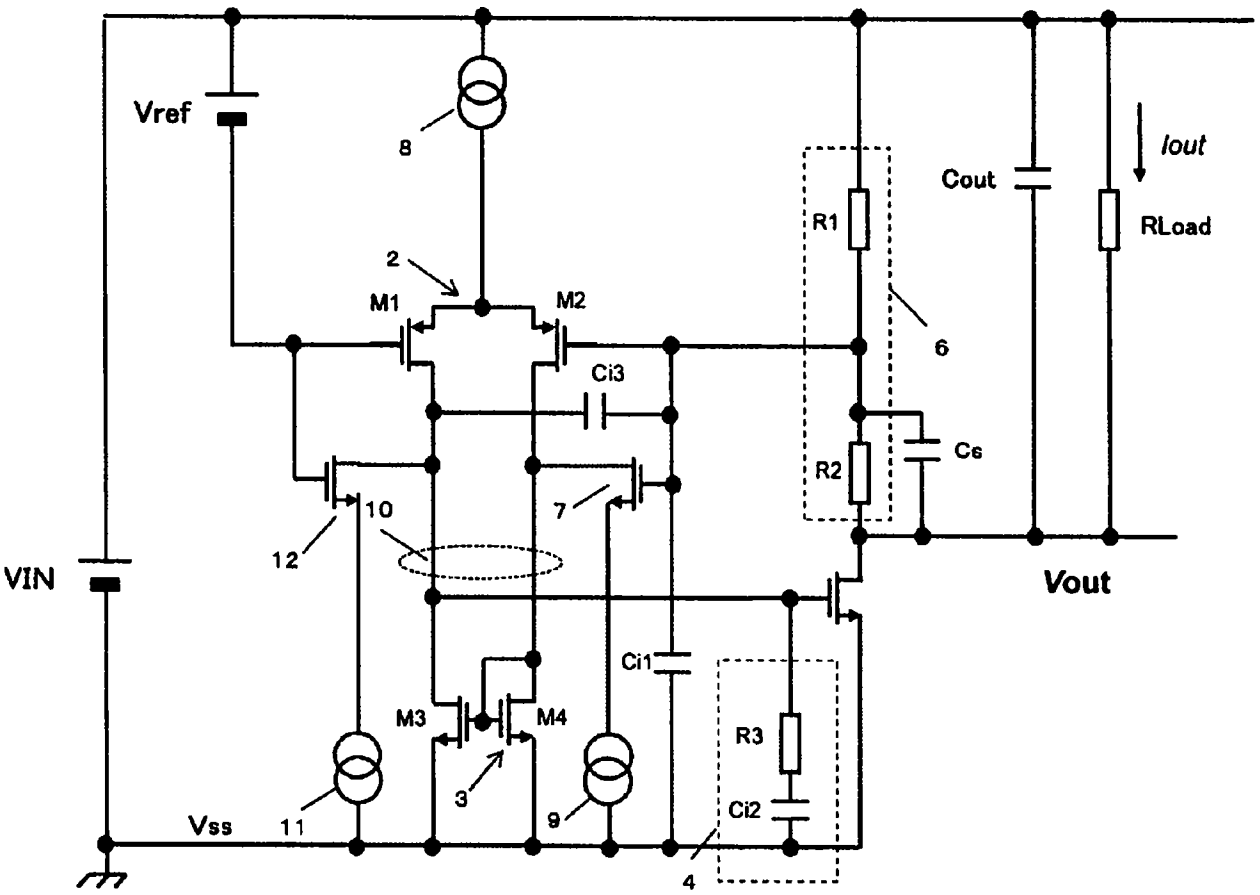
FIG. 17 is a circuit diagram illustrating the case in which the electroconductive type of the broadband transistor of the LDO regulator shown in FIG. 15 is inverted, so that the connection configuration of the circuit between the input voltage line and the ground line is also inverted.
Figure 18:
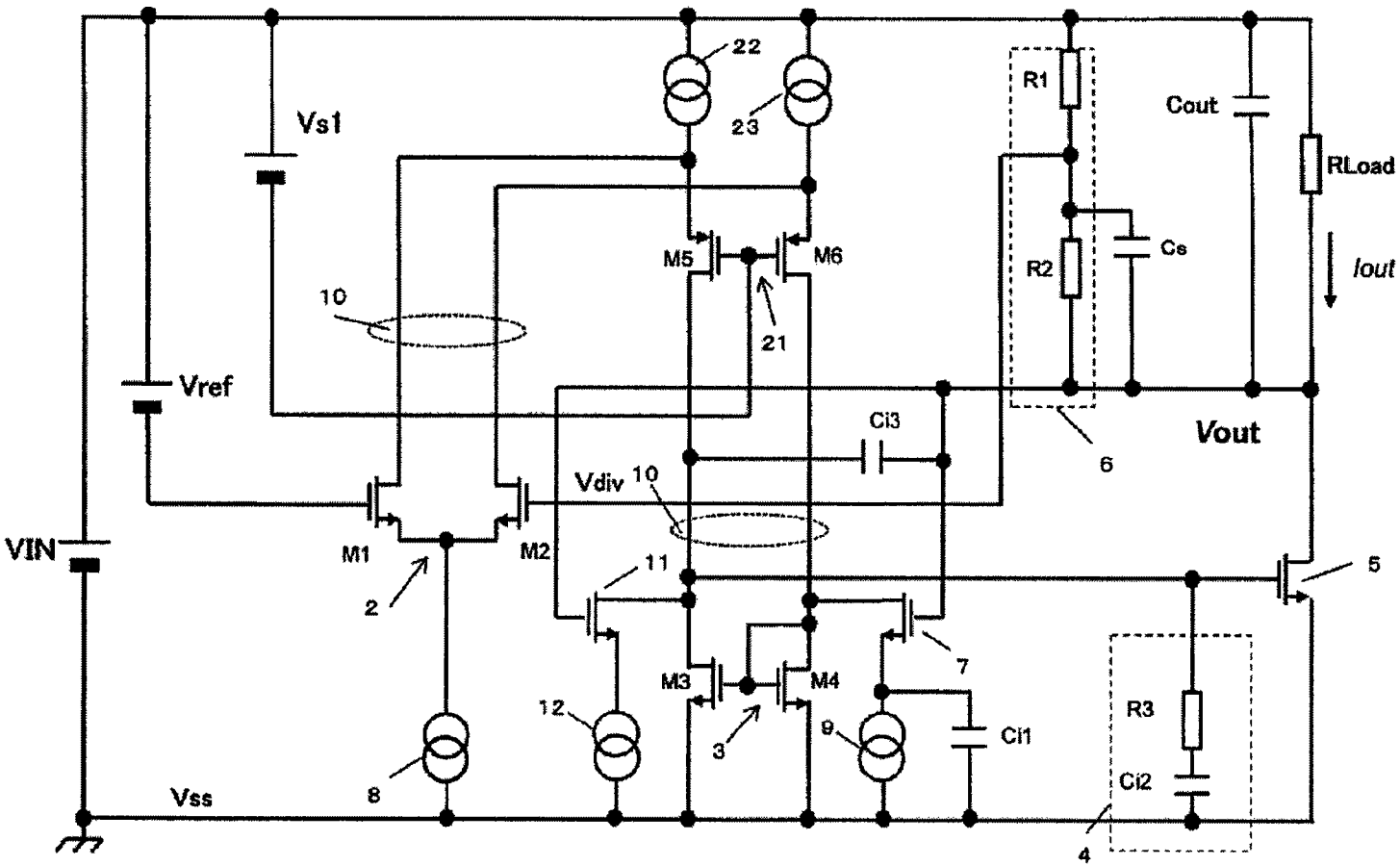
FIG. 18 is a circuit diagram illustrating the case in which the electroconductive type of the broadband transistor of the LDO regulator shown in FIG. 16 is inverted, so that the connection configuration of the circuit between the input voltage line and the ground line is also inverted.

In the LDO regulator 1 shown in FIG. 17 and FIG. 18 shown below, the electroconductive type is inverted to that of the broadband control transistor 7 of the LDO regulator 1 shown in FIG. 15 and FIG. 16, and the connection configuration between the input voltage line VIN and the ground line Vss is also inverted.

In the LDO regulator 1 shown in FIG. 17, there are the following parts: the broadband control transistor 7 and the second current source 9 connected in series between the drain of the PMOS transistor M2 in the differential circuit 2 and the ground line Vss, the phase compensating capacitor Ci1 connected between the gate of the broadband control transistor 7 and the ground line Vss, the NMOS transistor 12 and the third current source 11 connected in series between the drain of the PMOS transistor M1 and the ground line Vss, and the phase compensating capacitor Ci3 connected between the drain of the NMOS transistor 12 and the gate of the broadband control transistor 7.

For the LDO regulator 1 shown in FIG. 17, it is preferred that the second current source 9 and the third current source 11 have the same electrical characteristics, and that the broadband control transistor 7 and the PMOS transistor have the same electrical characteristics. Also, instead of connecting one end of each of the output capacitor Cout and the phase compensating capacitor Ci1 to the input voltage line VIN or the ground line Vss, they may also be connected to a stable voltage route with a low impedance. In addition, the phase compensating circuit 4 may be omitted.

The LDO regulator 1 shown in FIG. 18 has the following parts: the broadband control transistor 7 and the second current source 9 connected in series between the drain of the NMOS transistor M4 in the second current mirror circuit 21 and the ground line Vss, the phase compensating capacitor Ci1 connected in parallel with the second current source 9, the NMOS transistor 12 and the third current source 11 connected in series between the drain of the NMOS transistor M3 and the ground line Vss, and the phase compensating capacitor Ci3 connected between the drain of the NMOS transistor 12 and the gate of the broadband control transistor 7.

For the LDO regulator 1 shown in FIG. 18, it is preferred that the second current source 9 and the third current source 11 have the same electrical characteristics, the fourth current source 22 and the fifth current source 23 have the same electrical characteristics, and the broadband control transistor 7 and the NMOS transistor 12 have the same electrical characteristics. Also, instead of connecting one end of each of the output capacitor Cout and the phase compensating capacitor Ci1 to the input voltage line VIN or the ground line Vss, they may also be connected to a stable voltage route with a low impedance. In addition, the phase compensating circuit 4 may be omitted.

As shown in FIG. 17, the PMOS transistor 12 may be omitted. In addition, the third current source 11 may be omitted as well. In addition, as shown in FIG. 17, the gate of the broadband control transistor 7 may be connected to the output voltage line Vout. In addition, as shown in FIGS. 16 to 18, the phase compensating capacitor Ci3 may be omitted. In addition, the connecting site of the phase compensating capacitor Ci3 is not limited to what is shown in the figure.

As in the aforementioned Embodiments 2 to 9, just as in Embodiment 1, because there are the broadband control transistor 7, the second current source 9 and the phase compensating capacitor Ci1, it is possible to instantly amplify the high frequency signal superposed on the output voltage Vout, it is possible to realize a broader band, and a ceramic capacitor can be used as the output capacitor Cout.

In the aforementioned embodiments, an explanation has been made on the examples in which all of the transistors are MOS transistors that are formed on a chip. In alternative embodiments, it is also possible to use bipolar transistors.

For the LDO regulator 1 according to various embodiments, it may be adopted in combination with a switching regulator (containing a DC-DC converter) that carries out the switching operation. That is, after DC voltage conversion is carried out for increasing or decreasing the voltage by the switching regulator, in the LDO regulator 1, the output voltage Vout with a small voltage difference between the input/output voltages is generated and a load with significant variation in the load current, such as CPU or the like, may be connected thereto.

In the aforementioned embodiments, the divided voltage Vdiv obtained by dividing the output voltage Vout by the voltage dividing circuit 6 is fed back to the differential circuit 2. However, the voltage dividing circuit 6 is not a necessary constitution, and the output voltage Vout may also be fed back to the differential circuit 2 directly. In this case, the output voltage Vout is input to the gates of the transistor M2 and the broadband control transistor 7 in the differential circuit 2. That is, one may also adopt a scheme in which a voltage related to the output voltage Vout is applied on the various gates of the transistor M2 in the differential circuit 2 and the broadband control transistor 7.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A regulator comprising:

a differential circuit configured to generate a comparison signal based on a voltage difference between a reference voltage to be applied thereto and a voltage correlated to an output voltage of the regulator;

a first current source that supplies current to the differential circuit;

a first transistor that adjusts the output voltage based on a voltage corresponding to the comparison signal;

a first current mirror circuit connected with a pair of differential output lines of the differential circuit, the differential output lines including a first line that is connected to a gate of the first transistor and a second line;

a second transistor that amplifies a high frequency signal superposed on the output voltage and feeds the high frequency signal to the second line of the differential circuit;

a second current source that supplies the current for amplifying the high frequency signal in the second transistor; and a first capacitor, which accumulates charge therein as a result of the high frequency signal and controls the current flowing to the second line of the differential circuit via the second transistor in accordance with the accumulated charge quantity.

2. The regulator according to claim 1, wherein:

the first current mirror circuit sends a high frequency signal corresponding to the high frequency signal fed to the second line of the differential circuit to the first line of the differential circuit.

3. The regulator according to claim 1, further comprising:

a voltage dividing circuit that generates a divided voltage of the output voltage; and the divided voltage or the output voltage is input to a gate of the second transistor.

4. The regulator according to claim 1, further comprising:

a third current source for feeding current to the first line of the differential circuit.

5. The regulator according to claim 4, further comprising:

a third transistor, which is connected between the first line of the differential circuit and one end of the third current source, and which has gate to which a reference voltage is input to set a voltage at one end of the third current source at a constant voltage.

6. The regulator according to claim 5, further comprising:

a third capacitor, which has one end connected to one end of the third current source, and has the other end connected to the gate of the second transistor, wherein the capacitance of the third capacitor is two or more orders of magnitude smaller than the capacitance of the first capacitor.

7. The regulator according to claim 5, further comprising:

a third capacitor, which has one end connected to the first line of the differential circuit, and has the other end connected to the gate of the second transistor, wherein the capacitance of the third capacitor is two or more orders of magnitude smaller than the capacitance of the first capacitor.

8. The regulator according to claim 1, wherein the capacitance of the first capacitor is larger than 1/10 the gate capacitance of the first transistor.

9. The regulator according to claim 1, further comprising:

a ceramic capacitor connected to an output voltage line by which the output voltage is output.

10. The regulator according to claim 1, further comprising:

a second current mirror circuit inserted in the pair of differential output lines between the differential circuit and the first current mirror circuit, wherein the second transistor and the second current source are connected in series between a point on the second line of the differential circuit, which is between the first current mirror circuit and the second current mirror circuit, and a reference voltage line.

11. The regulator according to claim 1, further comprising:

a phase compensating circuit connected between an input voltage line by which the input voltage is supplied and the gate of the first transistor.

12. The regulator according to claim 1, wherein one end of each of the first and second current sources and the first capacitor connected to an output voltage line by which the output voltage is output, is connected to a ground line; and one end of each of the first transistor and the first current mirror circuit is connected to an input voltage line by which the input voltage is supplied.

13. The regulator according to claim 1, wherein one end of each of the first and second current sources and the first capacitor connected to an output voltage line by which the output voltage is output, is connected to a negative voltage line; and one end of each of the first transistor and the first current mirror circuit is connected to an input voltage line by which the input voltage is supplied.

14. The regulator according to claim 1, wherein one end of each of the first and second current sources and the first capacitor connected to an output voltage line by which the output voltage is output, is connected to an input voltage line by which the input voltage is supplied; and one end of each of the first transistor and the first current mirror circuit is connected to the ground line.

15. A regulator comprising:

a differential circuit configured to generate a comparison signal based on a voltage difference between a reference voltage to be applied thereto and a voltage correlated to an output voltage of the regulator;

a first current source that supplies current to the differential circuit;

a first transistor that adjusts the output voltage based on a voltage corresponding to the comparison signal;

a first current mirror circuit connected with a pair of differential output lines of the differential circuit, the differential output lines including a first line that is connected to a gate of the first transistor and a second line;

a second transistor that amplifies a high frequency signal superposed on the output voltage and feeds the high frequency signal to the second line of the differential circuit;

a second current source that supplies the current for amplifying the high frequency signal in the second transistor; and a first capacitor connected in parallel with the second current source between the second transistor and a prescribed voltage line; and a ceramic capacitor connected between an output voltage line by which the output voltage is output, and the prescribed voltage line.

16. The regulator according to claim 15, further comprising:

a voltage dividing circuit that generates a divided voltage of the output voltage; and the divided voltage or the output voltage is input to a gate of the second transistor.

17. The regulator according to claim 16, further comprising:

a third current source for feeding current to the first line of the differential circuit.

18. The regulator according to claim 17, further comprising:

a third transistor, which is connected between the first line of the differential circuit and one end of the third current source, and which has a gate to which a reference voltage is input to set a voltage at one end of the third current source at a constant voltage.

19. The regulator according to claim 15, wherein the differential circuit comprises a pair of NMOS transistors.

20. The regulator according to claim 15, wherein parameters of the second transistor, the first capacitor, and the second current source are set to reduce oscillations in the output voltage.

21. A regulator comprising:

a differential circuit configured to generate a comparison signal based on a voltage difference between a reference voltage to be applied thereto and a divided voltage correlated to an output voltage of the regulator;

a first current source that supplies current to the differential circuit;

a first transistor that adjusts the output voltage based on a voltage corresponding to the comparison signal;

a first current mirror circuit connected with a pair of differential output lines of the differential circuit, the differential output lines including a first line that is connected to a gate of the first transistor and a second line;

a voltage dividing circuit configured to generate the divided voltage correlated to the output voltage;

a first capacitor and a second current source connected in parallel each other;

a second transistor having a gate that is supplied with one of the divided voltage and the output voltage, a level of the divided or output voltage determining whether or not current is supplied from the second line of the differential circuit through the second transistor to the first capacitor and the second current source.

22. The regulator according claim 21, wherein the differential circuit comprises a pair of transistors in which sources are connected in common; and one of the pair of transistors comprises a gate that is supplied with the divided voltage and a drain connected to a drain of the second transistor.

23. The regulator according claim 21, wherein the second transistor controls a level of current in the second line of the differential circuit according to a high frequency signal superposed on the output voltage;

the first current mirror circuit controls a level of current in the first line of the differential circuit in relation to the level of current in the second line of the differential circuit; and the first transistor adjusts the output voltage according to a voltage of the second line of the differential circuit.

* * * * *